US006018282A

United States Patent [19]

Tsuda

[11] Patent Number: 6,018,282

[45] Date of Patent: Jan. 25, 2000

[54] VOLTAGE-CONTROLLED VARIABLE-PASSBAND FILTER AND HIGH-FREQUENCY CIRCUIT MODULE INCORPORATING SAME

[75] Inventor: Yoichi Tsuda, Tenri, Japan

[73] Assignee: Sharp Kabushiki Kaisha, Osaka, Japan

[21] Appl. No.: 08/965,229

[22] Filed: Nov. 6, 1997

[30] Foreign Application Priority Data

Nov. 19, 1996 [JP] Japan ..... 8-308043
Aug. 25, 1997 [JP] Japan ..... 9-228581

[51] Int. Cl.[7] ..... H01P 1/203

[52] U.S. Cl. ..... 333/205; 333/235; 333/246

[58] Field of Search ..... 333/202, 174, 333/175, 205, 235, 995, 246; 361/321.1, 313, 311, 306.3

[56] References Cited

U.S. PATENT DOCUMENTS

| | | | |
|---|---|---|---|
| 3,569,795 | 3/1971 | Gikow | 361/434 |
| 4,835,499 | 5/1989 | Pickett | 333/205 |
| 5,166,646 | 11/1992 | Avanic et al. | 331/107 A |
| 5,334,958 | 8/1994 | Babbitt | 333/156 |
| 5,496,795 | 3/1996 | Das | 333/205 |
| 5,627,502 | 5/1997 | Ervasti | 333/134 |
| 5,640,042 | 6/1997 | Koscica et al. | 333/99 S |

FOREIGN PATENT DOCUMENTS

| | | |
|---|---|---|
| 59-229914 | 12/1984 | Japan . |
| 61-227414 | 10/1986 | Japan . |
| 62-281319 | 12/1987 | Japan . |
| 63-128618 | 6/1988 | Japan . |
| 2302017 | 12/1990 | Japan . |
| 519969 | 3/1993 | Japan . |
| 563487 | 3/1993 | Japan . |
| 5235609 | 9/1993 | Japan . |
| 7131367 | 5/1995 | Japan . |
| 8102636 | 4/1996 | Japan . |
| WO94/13028 | 6/1994 | WIPO . |

*Primary Examiner*—Seungsook Ham
*Attorney, Agent, or Firm*—David G. Conlin; Richard E. Gamache

[57] ABSTRACT

The voltage-controlled variable-passband filter in accordance with the present invention is structured so that conductive patterns, R, L, and C, and other circuit elements are embedded in a ceramic substrate. Within this substrate is also embedded an insulating layer made of the same ceramic material, the capacitance of which changes in response to an electric field applied thereto. On one surface of the insulating layer is provided a control electrode, and on the other surface are provided adjacent to one another a resonator pattern, to which high-frequency signals are applied, and a ground pattern. Accordingly, two capacitors connected in series are formed between the resonator pattern and the ground pattern, and the capacitance of these series capacitors can be adjusted by an integrated circuit mounted on the ceramic substrate, thus reducing size and weight, and simplifying adjustment.

8 Claims, 25 Drawing Sheets

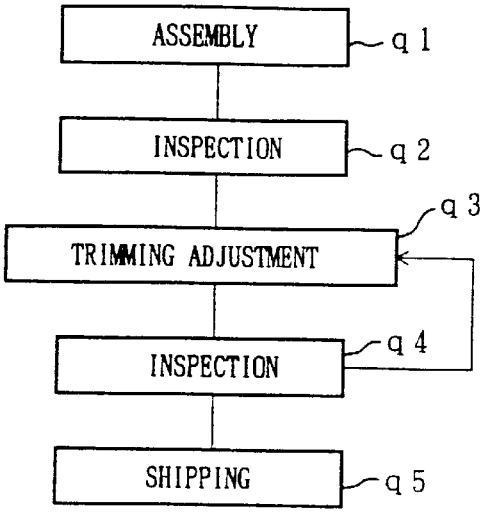
FIG. 29 PRIOR ART
FIG. 30(a)
PRIOR ART
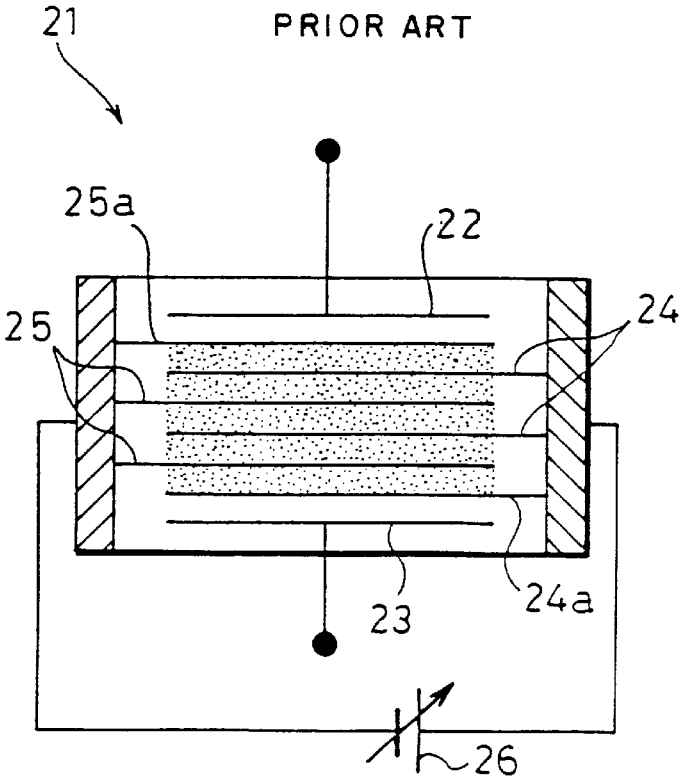
FIG. 30(b)
PRIOR ART
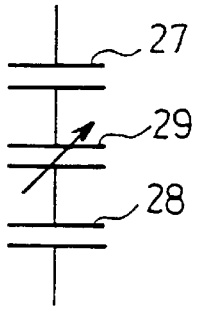

VOLTAGE-CONTROLLED VARIABLE-PASSBAND FILTER AND HIGH-FREQUENCY CIRCUIT MODULE INCORPORATING SAME

FIELD OF THE INVENTION

The present invention concerns a filter with a voltage-controlled variable passband, capable of switching filter characteristics by changing a direct-current control voltage, which can be suitably implemented as a high-frequency filter for use in radio transmission devices, thereby enabling the device to be adapted to a plurality of radio transmission systems, and also concerns a high-frequency circuit module incorporating the voltage-controlled variable-passband filter.

BACKGROUND OF THE INVENTION

In recent years, radio transmission devices with increasingly high performance have been realized, but devices with even higher performance, able to be adapted to a plurality of radio transmission systems, are needed. An example of this type of device would be one incorporating the functions of both (1) a PDC (Personal Digital Cellular: the so-called regular portable phone) device, which has a large transmission area and enables transmission even when moving at high speed; and (2) a PHS (Personal Handy-phone System, or the so-called "Second-Generation Cordless Telephone System") device, with its low telephone charges and high-speed data transfer; thereby enabling switching between these functions as needed.

A terminal device for a portable phone able to function as a shared PDC/PHS unit could be realized, for example, by a terminal device 31 shown in FIG. 25. Audio signals picked up by a microphone 32 are sent through an amplifier 33 to an analog/digital converter 34, where they are converted to digital signals, which are sent to a processing circuit 35, where they are modulated into transmission signals. Received signals, on the other hand, are demodulated by the processing circuit 35, converted into analog signals by a digital/analog converter 36, and then amplified by an amplifier 37 and turned into sounds by a speaker 38.

An input operating means 40, such as a ten-key pad, and a display means 41, realized by a liquid crystal panel or other device, are connected to the processing circuit 35 through an interface 39.

The transmission signals from the processing circuit 35, after amplification by an amplifier al, are sent through either of two filters fcl or fsl, and transmitted from an antenna 42. The received signals received by the antenna 42, on the other hand, are sent through either of two filters fc2 or fs2 to an amplifier a2, where they are amplified, and then sent to the processing circuit 35. The filters fc1 and fc2 are PDC band pass filters with center frequency set in the vicinity of 1.5 GHz, while the filters fs1 and fs2 are PHS band pass filters with center frequency set in the vicinity of 1.9 GHz.

In order to switch between the pair of filters fc1, fc2 and the pair of filters fs1, fs2 when switching from PDC to PHS use or vice versa, the terminal device 31 is provided with two pairs of switches (s11 and s12; s21 and s22) and a control circuit 43 which performs the switching control. The control circuit 43 performs switching control by operating the switches s11 and s12 or s21 and s22 in concert according to whether the terminal device 31 is being used with the PDC or PHS system, and whether the transmission or reception time slot is in effect.

It can be seen from the explanation above that the terminal device 31 could be greatly reduced in size if filter characteristics were made variable.

In order to achieve variable filter characteristics in a high-frequency filter for radio transmission devices, conventional art has often used a variable-capacity diode, as disclosed, for example, by Japanese Unexamined Patent Publication Nos. 7-131367/1995, 61-227414/1986, 5-63487/1993, 5-235609/1993, 7-283603/1995, and 8-102636/1996.

As one example, FIG. 26 shows the equivalent circuit of a voltage-controlled variable-passband filter 1 according to Japanese Unexamined Patent Publication No. 7-131367/1995. As is evident from the voltage-controlled variable-passband filter 1, the conventional art is structured so that variable-capacity diodes 4 and 5 are connected between input/output terminals p1 and p2 in a filter circuit having resonator patterns 2 and 3, thereby ensuring that desired filter characteristics are obtained by changing the capacitance of the variable-capacity diodes 4 and 5 by means of a direct-current control voltage applied to a control terminal p3.

Another example is a resonating circuit for use in oscillating circuits and elsewhere, such as that disclosed by Japanese Unexamined Patent Publication No. 59-229914/1984. As shown in FIG. 27, in resonating circuit 11 a plurality of series variable-capacity diodes 12 and a plurality of series variable-capacity diodes 13 are connected in reverse series with relation to each other, and a coil 14 is connected in parallel with the series circuit.

A resonating output signal is obtained from an input/output terminal p4, and a direct-current control voltage from a control terminal p5 is divided as needed and applied to each connection of the variable-capacity diodes 12 and 13. In this way, by connecting the variable-capacity diodes 12 and 13 in a multi-stage series structure, stable resonance characteristics can be ensured, even if the resonating signal obtained from the input/output terminal p4 is high in voltage.

An alternative to the use of variable-capacity diodes (4, 5, 12 and 13 above) for obtaining desired filter characteristics is disclosed by, for example, Japanese Unexamined Patent Publication Nos. 2-302017/1990, 62-259417/1987, 62-281319/1987, and 63-128618/1988. This is a method in which capacitance is changed by the use of voltage-controlled variable-capacity capacitors.

FIG. 28 is a cross-sectional diagram schematically showing the structure of a voltage-controlled variable-capacity capacitor 21 according to Japanese Unexamined Patent Publication No. 2-302017/1990. This voltage-controlled variable-capacity capacitor 21 is structured so that, between a pair of parallel plate capacitive electrodes 22 and 23, a plurality of bias field applying electrodes 24 and oppositely charged bias field applying electrodes 25 alternate with each other, with ferroelectric ceramic material lying between these electrodes.

By connecting a bias power source 26 between the bias field applying electrodes 24 and the bias field applying electrodes 25 and changing the direct-current voltage outputted by the bias power source 26, the electric field applied to the ferroelectric ceramic material is changed, thereby causing the dielectric constant to change. Thus the capacitance of the ferroelectric ceramic material is changed. Accordingly, in the voltage-controlled variable-capacity capacitor 21, variable capacitance can be produced within the ceramic substrate itself.

When structuring a high-frequency circuit module using the voltage-controlled variable-passband filter 1 or the voltage-controlled variable-capacity capacitor 21, in the interests of small size, it is desirable to form the circuit pattern within a multi-layer substrate. However, since actual component mounting and other steps of the assembly process tend to create unevenness, it becomes necessary to prepare in advance a pattern for adjustment purposes, and to make adjustments by trimming the adjustment pattern while confirming the circuit characteristics, until the desired characteristics are obtained.

In other words, as shown in FIG. 29, when mounting and soldering of components and other operations for assembly of a module have been completed in Step q1, the module is inspected in Step q2. Trimming adjustment is made in Step q3 on the basis of the inspection results, and then a further inspection in Step q4 and further trimming adjustment in Step q3 are repeated until the desired characteristics are obtained, after which the module is shipped in Step q5.

Further, in structures which use variable-capacity diodes like those mentioned above (4 and 5 in FIG. 26 and 12 and 13 in FIG. 27), semiconductor materials such as Si, GaAs, and Ge are used for these variable-capacity diodes 4, 5 and 12, 13. Accordingly, it is not possible to integrally provide these variable-capacity diodes 4, 5 and 12, 13, and the remainder of the circuit within the ceramic substrate. Thus, they must be attached externally after the high-frequency filter circuit substrate is formed. Accordingly, these structures have the drawback that the number of components and assembly steps is increased.

Further, the characteristics of these variable-capacity diodes 4, 5 and 12, 13 are influenced by the high-frequency signals which are to be handled, but when the variable-capacity diodes 12 and 13 are connected in a multistage series as in the resonating circuit 11, this influence can be reduced.

However, since the required control voltage increases in proportion to the number of series stages of the diodes 12 and 13, thereby burdening the control voltage source, and with battery-driven portable devices there is the drawback that a booster circuit must be used to boost the low power source voltage to a voltage corresponding to the required control voltage.

In the voltage-controlled variable-capacity capacitor 21, which is made of ferroelectric ceramic material, the bias field applying electrodes 24 and 25 are provided between the two terminal electrodes 22 and 23; however, although the dielectric constant of the ferroelectric material between the bias field applying electrodes 24*a* and 25*a* (the shaded area in FIG. 30 (*a*)) is changed, that of the area outside the bias field applying electrodes 24*a* and 25*a* is not changed.

Accordingly, the equivalent circuit for this structure, as shown in FIG. 30 (*b*), is one in which a variable-capacity capacitor 29 with relatively high capacitance is connected in series between two other fixed-capacitance capacitors 27 and 28 with relatively low capacitance. Accordingly, given the characteristics of serial connection of capacitors, the influence of the relatively low-capacitance terminal capacitors 27 and 28 is great, and even a great change in the capacitance of the relatively high-capacitance capacitor 29 will not greatly change the total composite capacitance. Thus the problem remains that a great change in bias voltage is necessary to greatly change the composite capacitance.

Another problem with the conventional art is that, when trimming is used to adjust the characteristics of the high-frequency circuit module, excessive trimming cannot be restored, and since adjustment becomes impossible, the yield is reduced.

SUMMARY OF THE INVENTION

The object of the present invention is to provide a voltage-controlled variable-passband filter capable of achieving small size and light weight, with easily adjusted characteristics, and a high-frequency module incorporating the filter.

The first voltage-controlled variable-passband filter of the present invention comprises:

(1) a voltage-controlled variable capacitance capacitor with a two-stage series structure, provided with (*a*) an insulating layer made of a dielectric substance the dielectric constant of which changes in response to an electric field applied thereto, (*b*) a first electrode, provided on one surface of the insulating layer, to which is applied control voltage to produce the electric field, and (*c*) second and third electrodes, provided on the other surface of the insulating layer adjacent to and parallel with each other, to which high-frequency signals are applied; conductive areas of the first electrode opposite the second and third electrodes acting as capacitive electrodes, with the respective capacitive electrodes and second and third electrodes providing two capacitors connected in series; and (2) a control voltage applying means for applying a control voltage to the first electrode.

With the above structure, since an insulating layer made of a dielectric material, the dielectric constant of which changes in response to an electric field applied thereto, is integrally provided within a high-frequency circuit substrate or other substrate during the manufacturing process thereof, a voltage-controlled variable-capacity capacitor need not be externally attached to the filter circuit substrate. The problem shown in FIG. 30 (*b*) which usually arises with a structure of this kind is solved by providing on one surface of the insulating layer of dielectric material a first electrode for applying control voltage, and providing on the opposing surface second and third electrodes, to which are applied the high-frequency signals, with two conductive areas of the first electrode opposite the second and third electrodes acting as capacitive electrodes, with the capacitive electrodes and the second and third electrodes providing two capacitors connected in series.

Accordingly, a uniform electric field is applied to the entire part of the insulating layer lying between the first electrode on the one hand and the second and third electrodes on the other. Thus the entire change in the dielectric constant produced by change in the control voltage contributes to a change in the capacitance, and a comparatively large change in capacitance can be obtained by a comparatively small change in the control voltage. Further, since the variable-capacity capacitor which replaces the externally-attached variable-capacity diode of the conventional art can be provided without external attachment, size and weight can be reduced, and the assembly process can be simplified.

In addition, switching of the control voltage is performed by an exclusive control voltage applying means, which enables switching from one adjusting method to another, i.e., when adjusting so that the resonating frequency becomes higher, it is possible to readjust so that the resonating frequency becomes lower. This method of adjustment eliminates inadequate adjustment, thus improving the yield over other adjustment methods such as trimming, and also makes the adjustment easy to perform.

The present invention can also be arranged so that a plurality of first electrodes connected in parallel with one another is used, with the second and third electrodes positioned opposite the first- and last-stage electrodes, respectively, of the first electrode, with a plurality of ground electrodes positioned opposite and staggered with the plurality of first electrodes.

In this case, when the capacitor, i.e., the capacitor between the second and third electrodes, requires a high withstand voltage, capacitors are connected in series between these two terminals in a multi-stage manner, but a control voltage for changing the capacitance of these capacitors is applied by the staggered first electrodes and ground electrodes.

Accordingly, since this voltage-controlled variable-capacity capacitor is, in appearance, made up of a multi-stage arrangement of capacitors, the influence of the high-frequency signals to be handled on the control voltage is reduced to 1/n, where n is the number of capacitor stages. Thus, change in the capacitance of the voltage-controlled variable-capacity capacitor due to changes in the voltage of the high-frequency signals can be held to a minimum. Further, the control voltage necessary will be the same as that for a single stage, and thus no special structure is needed for the control voltage power source, thus simplifying the overall structure.

The other objects, features, and strengths of the present invention will be made clear by the description below. In addition, the advantages of the present invention will be evident from the following explanation in reference to the drawings.

BRIEF DESCRIPTION OF THE DRAWINGS

FIG. 29 is a flow chart explaining the manufacturing process of a high-frequency circuit module which includes the voltage-controlled variable-passband filter shown in FIG. 26 and the voltage-controlled variable-capacity capacitor shown in FIG. 28.

FIGS. 30(*a*) and 30(*b*) are a cross-sectional view and an equivalent circuit diagram, respectively, explaining the operations of the voltage-controlled variable-capacity capacitor shown in FIG. 28.

DESCRIPTION OF THE EMBODIMENTS

The following is an explanation of the first embodiment of the present invention, in reference to FIGS. 1 through 13.

Figure 1:
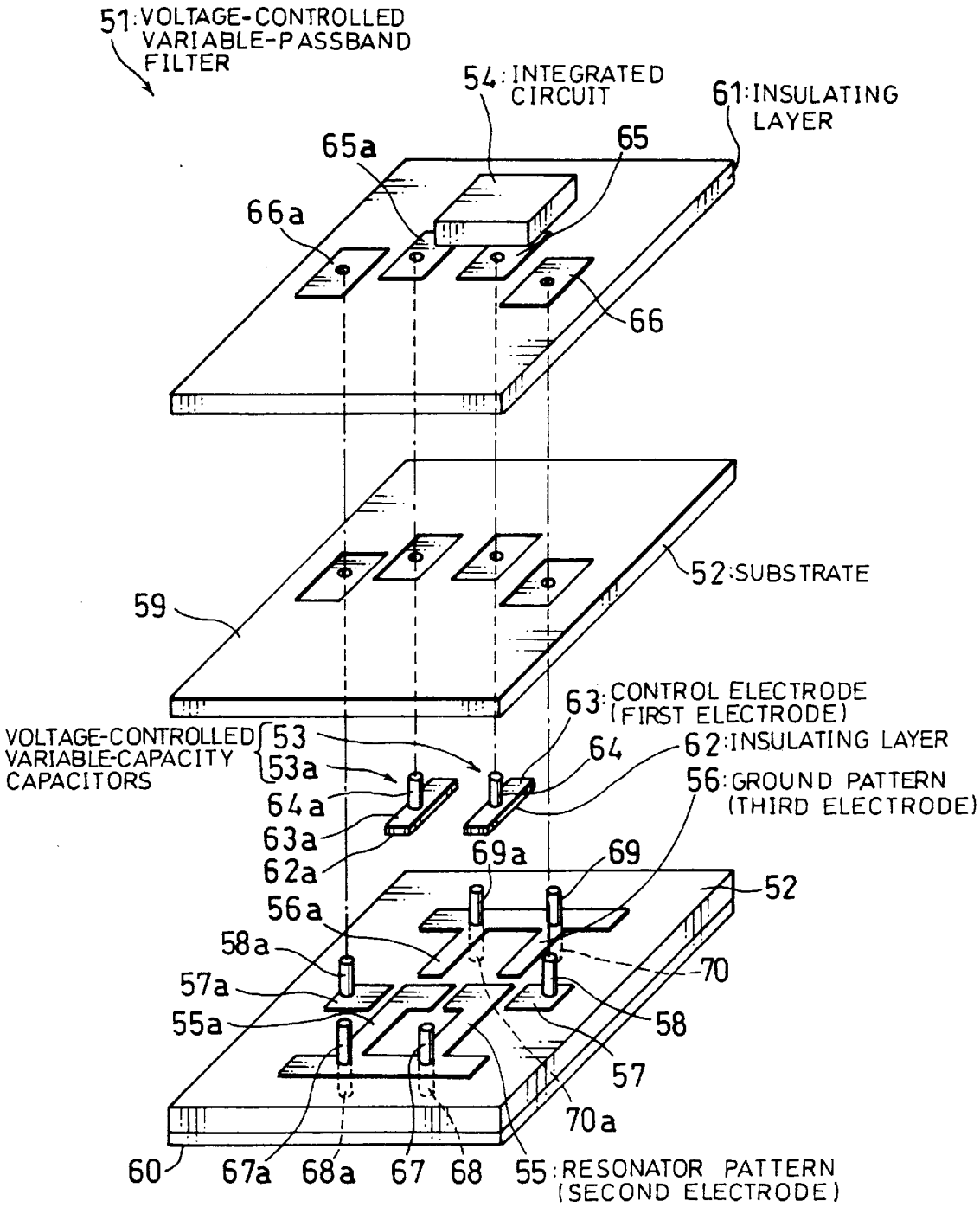
FIG. 1 is an exploded oblique view showing the structure of a voltage-controlled variable-passband filter according to the first embodiment of the present invention.

FIG. 1 is an exploded oblique view of a voltage-controlled variable-passband filter 51 according to the first embodiment of the present invention. The voltage-controlled variable-passband filter 51 is arranged so that, within a substrate 52 made of ceramic material chiefly composed of titanium oxide, barium oxide, or a similar material are provided filter circuit patterns and voltage-controlled variable-capacity capacitors 53 and 53*a* according to the present invention (which will be described below), and so that an integrated circuit 54 for controlling the voltage-controlled variable-capacity capacitors 53 and 53*a* is mounted on the substrate 52. The voltage-controlled variable-capacity capacitor 53*a* is structured in the same manner as the voltage-controlled variable-capacity capacitor 53, and accordingly the following explanation will treat the structure and members of the voltage-controlled variable-capacity capacitor 53, with corresponding members of the voltage-controlled variable-capacity capacitor 53*a* given the same reference numerals with the addition of the letter a.

The voltage-controlled variable-passband filter 51 is a filter with strip line structure, in which patterns 55, 56, and 57, made of flat conductor, are embedded within the substrate 52, and ground conductive layers 59 and 60, which function as shield conductors, are provided on both surfaces of the substrate 52. The integrated circuit 54 is mounted on the ground conductive layer 59, but is separated from it by an insulating layer 61 made of ceramic material.

Figure 2:
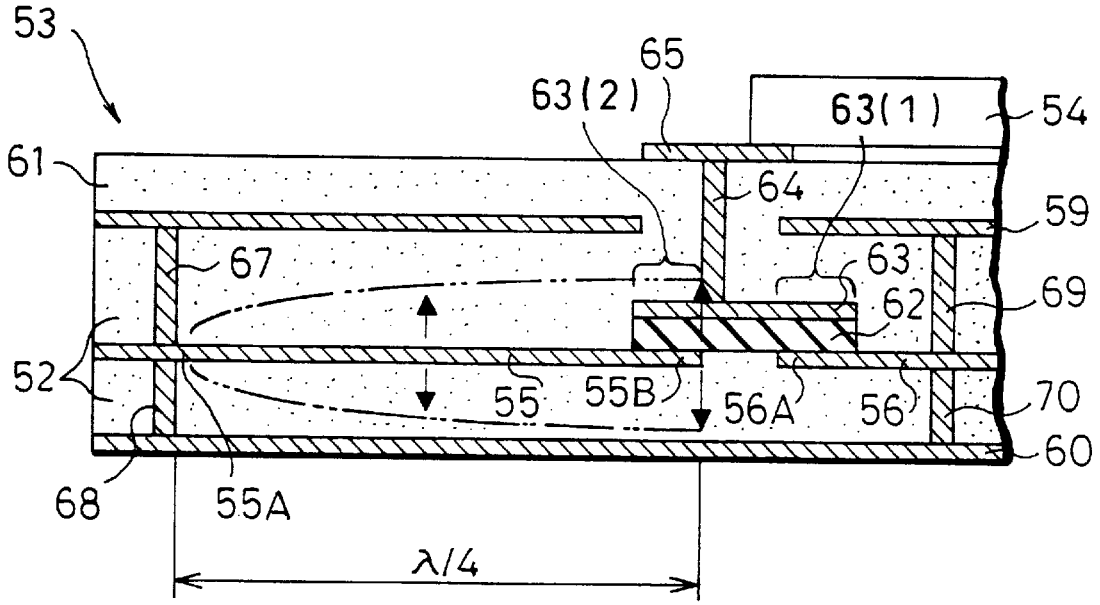
FIG. 2 is a vertical cross-sectional view showing the structure of the voltage-controlled variable-passband filter shown in FIG. 1.

FIG. 2 is an enlarged vertical cross-sectional view of the voltage-controlled variable-capacity capacitor 53. A resonator pattern 55 functions as a resonator conductor, and forms a pair with a resonator pattern 55*a*. One end 55A of the resonator pattern 55 is connected to the ground conductive layers 59 and 60 by via holes 67 and 68, respectively, and acts as a short-circuit end, with the other end 55B of the resonator pattern 55 serving as an open end. A ground pattern 56 is connected to the ground conductive layers 59 and 60 by via holes 69 and 70, respectively, and one end 56A of the ground pattern 56 is provided so as to be adjacent to the end 55B of the resonator pattern 55.

The end 55B of the resonator pattern 55 and the end 56A of the ground pattern 56 are provided on the insulating layer 62. The insulating layer 62 is made of a ceramic material selected from the group consisting of $BaTiO_3$, $SrTiO_3$, $Ba_xSr_{1-x}TiO_3$, $PbLaTiO_3$, $Bi_4Ti_3O_{12}$, PZT, and $PbTiO_3$. On the surface of the insulating layer 62 opposite that where the patterns 55 and 56 are provided is provided a control electrode 63. The control electrode 63 is connected to the integrated circuit 54 by a via hole 64 and by a control voltage terminal 65, which is provided on the insulating layer 61.

The insulating layer 62 has characteristics whereby its dielectric constant changes in response to the strength of an electric field applied thereto. In other words, the dielectric constant of the insulating layer 62 changes according to the voltage applied between the control electrode 63 and the patterns 55 and 56. The thickness of the insulating layer 62 is determined on the basis of the control voltage which the integrated circuit 54 is able to apply, the desired amount of change in the dielectric constant, and the width of the patterns 55 and 56 and the control electrode 63, and will be, for example, approximately 0.1 $\mu$m to 10 $\mu$m.

The resonator pattern 55 is provided so that its length from the short-circuit end 55A to the open end 55B is $\lambda/4$, where $\lambda$ is the wavelength of the high-frequency signal to be handled. An input/output terminal 66 is provided on the insulating layer 61, and is connected to an input/output pattern 57 by a via hole 58.

Figure 3:
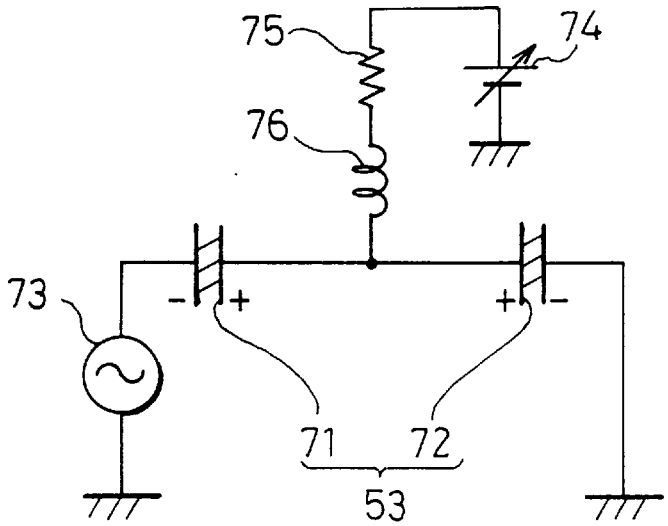
FIG. 3 is an equivalent circuit diagram showing the structure of the voltage-controlled variable-capacity capacitor and the mechanism for applying a control voltage in the voltage-controlled variable-passband filter shown in FIGS. 1 and 2.

FIG. 3 is an equivalent circuit diagram showing, of the voltage-controlled variable-passband filter 51 structured as above, the structure of the voltage-controlled variable-capacity capacitor 53 and the portion of the circuit for applying the control voltage thereto. The voltage-controlled variable-capacity capacitor 53 is a capacitor with a three-electrode structure, in which a first capacitor 71 and a second capacitor 72 are connected in series. The capacitive electrode of the first capacitor 71 is the conductive area 63(2) shown in FIG. 2, where the insulating layer 62 falls between the end 55B of the resonator pattern 55 (acting as a second electrode) and the control electrode 63 (acting as a first electrode), and the capacitive electrode of the second capacitor 72 is the conductive area 63(1) shown in FIG. 2, where the insulating layer 62 falls between the end 56A of the ground pattern 56 (acting as a third electrode) and the control electrode 63.

One terminal of the capacitor 71 is connected to a high-frequency signal source 73 (corresponding to the open-end electrode of the resonator pattern 55, which is a resonator conductor), and one terminal of the capacitor 72 is connected to a ground (corresponding to the ground pattern 56). The respective other terminals of the capacitors 71 and 72 are connected to each other, and a direct-current control voltage from a control voltage source 74 (corresponding to the integrated circuit 54) is applied to the mutually-connected terminals of capacitors 71 and 72 through a resistor 75 and an inductor 76 (which correspond to the via holes 64 and 64*a*).

Figure 4:
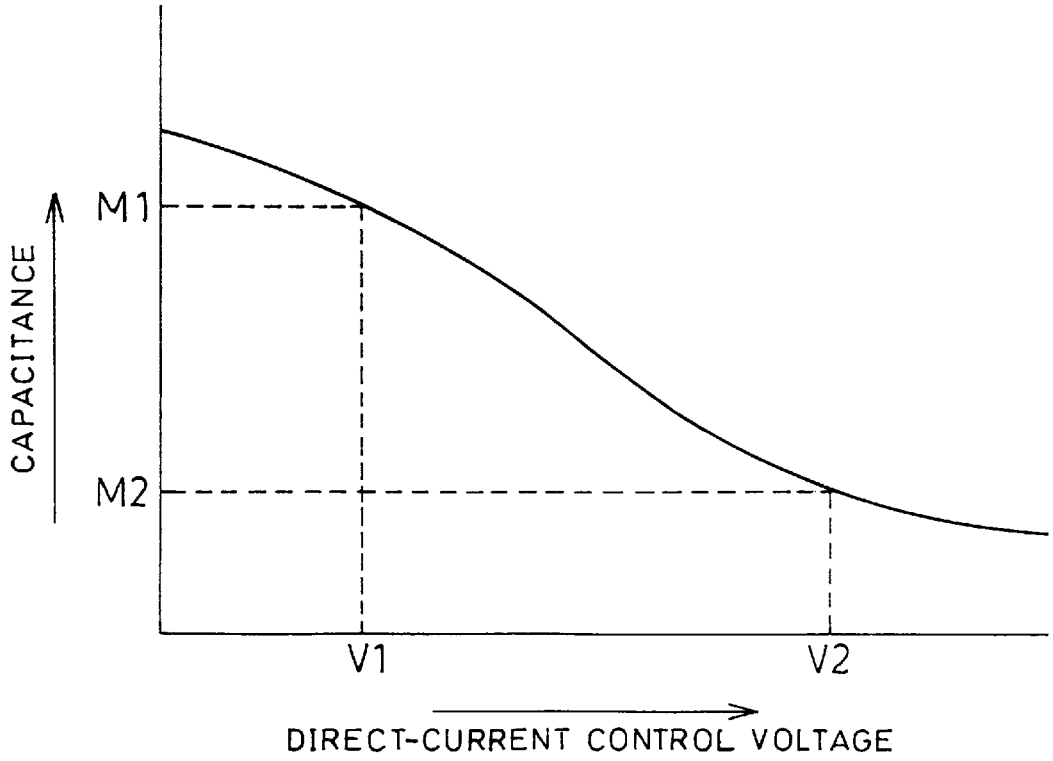
FIG. 4 is a graph showing how the capacitance changes in response to the direct-current control voltage in the voltage-controlled variable-capacity capacitor.
Figure 5:
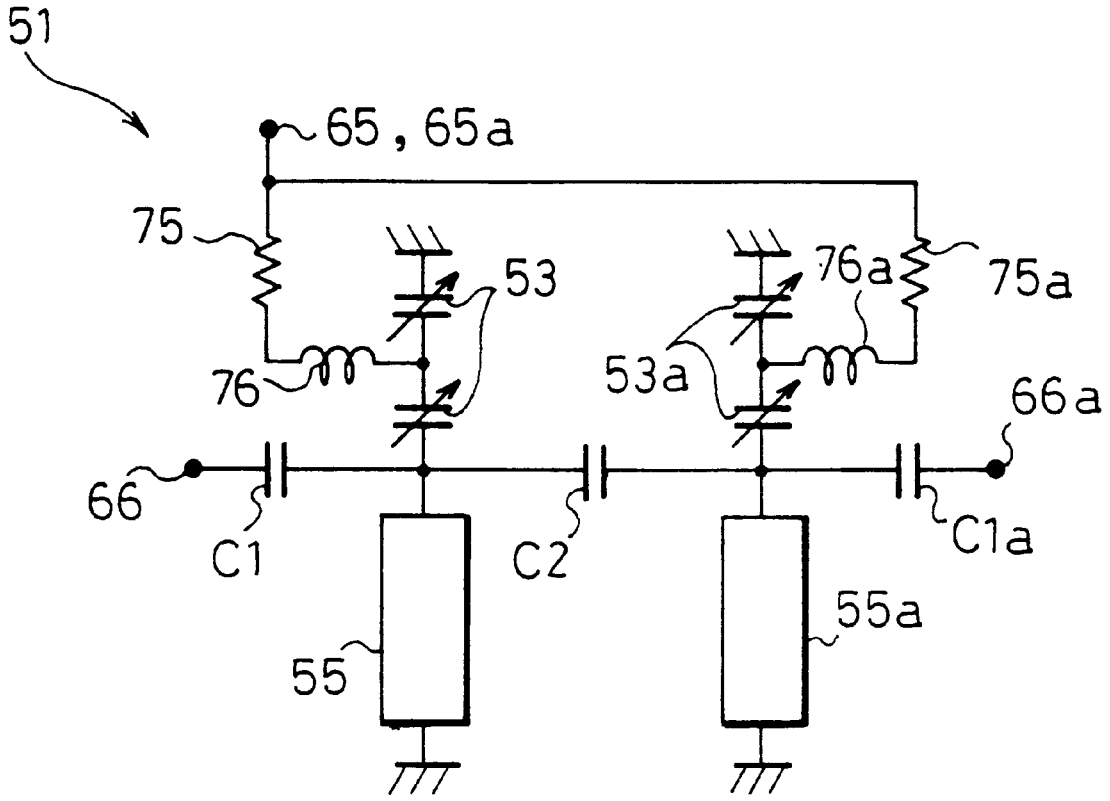
FIG. 5 is an equivalent circuit diagram of the voltage-controlled variable-passband filter shown in FIGS. 1 and 2.

By providing the insulating layer 62 and the control electrode 63 and the patterns 55 and 56, the two capacitors 71 and 72 are given substantially the same capacitances and other electrical characteristics, and as a result capacitance can be effectively controlled by a low control voltage. If these two capacitors 71 and 72 are considered a single capacitor, then, as shown in FIG. 4, then capacitance can be reduced (M1→M2) by increasing the direct-current control voltage (V1→V2). Accordingly, the equivalent circuit for the voltage-controlled variable-passband filter 51 having, as shown in FIG. 1, a pair of resonator patterns 55 and 55*a* and a pair of voltage-controlled variable-capacity capacitors 53 and 53*a* is as shown in FIG. 5.

In other words, it is a two-stage parallel resonating circuit made up of the voltage-controlled variable-capacity capacitors 53 and 53*a*, and the resonator patterns 55 and 55*a*. Each of the resonator patterns 55 and 55*a* is a quarter-wavelength resonator, and each functions as an inductor and a capacitor. The direct-current control voltage from the control voltage terminals 65 and 65*a* is applied to the voltage-controlled variable-capacity capacitors 53 and 53*a* through the resistors 75 and 75*a* and the inductors 76 and 76*a*, respectively, thus changing the capacitances of the capacitors 53 and 53*a*.

Between (1) the input/output terminal 66 and (2) the parallel resonating circuit made up of the voltage-controlled variable-capacity capacitor 53 and the resonator pattern 55, there is a coupled capacitance C1 created by the input/output pattern 57 and the resonator pattern 55, and in the same manner, between (1) the input/output terminal 66*a* and (2) the parallel resonating circuit made up of the voltage-controlled variable-capacity capacitor 53*a* and the resonator pattern 55*a*, there is a coupled capacitance C1*a* created by the input/output pattern 57*a* and the resonator pattern 55*a*. Further, between (1) the parallel resonating circuit made up of the voltage-controlled variable-capacity capacitor 53 and the resonator pattern 55 and (2) the parallel resonating circuit made up of the voltage-controlled variable-capacity capacitor 53*a* and the resonator pattern 55*a*, there is a coupled capacitance C2 created between the resonator patters 55 and 55*a*.

Figure 6:
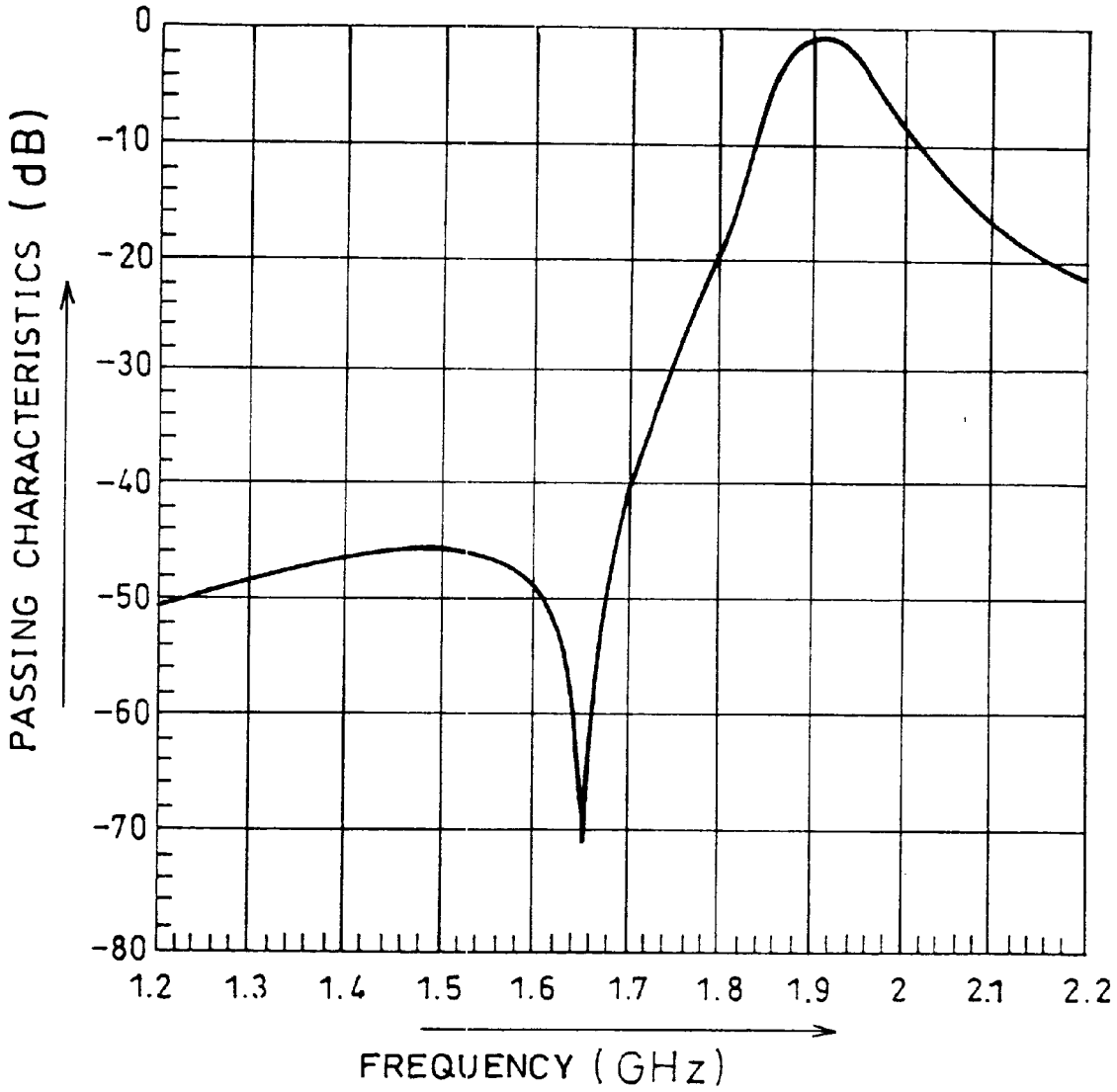
FIG. 6 is a graph explaining how the characteristics of the voltage-controlled variable-passband filter change in response to a direct-current control voltage, and showing the characteristics for the PHS system.
Figure 7:
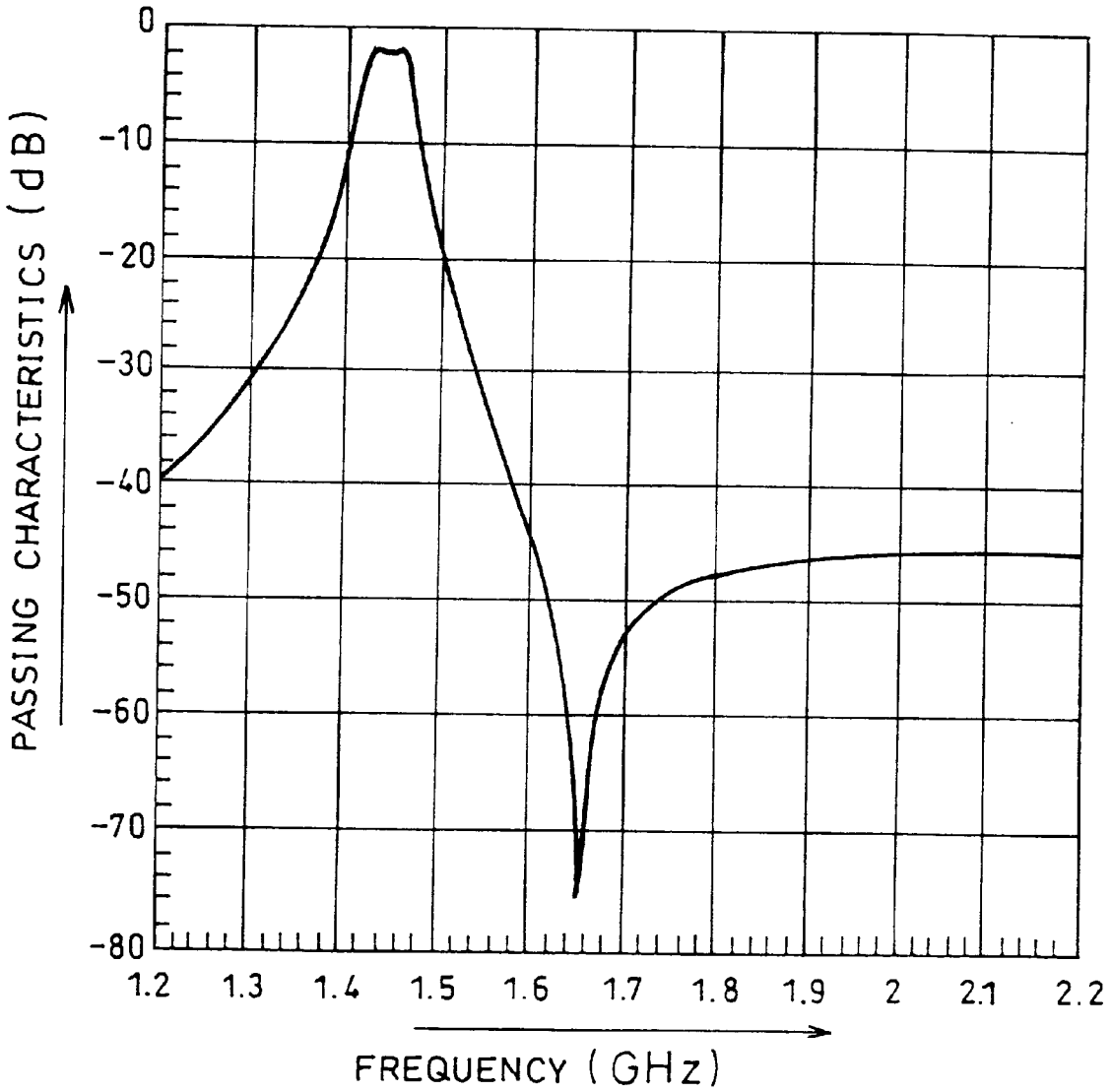
FIG. 7 is a graph explaining how the characteristics of the voltage-controlled variable-passband filter change in response to a direct-current control voltage, and showing the characteristics for a transmission circuit for the PDC system.
Figure 8:
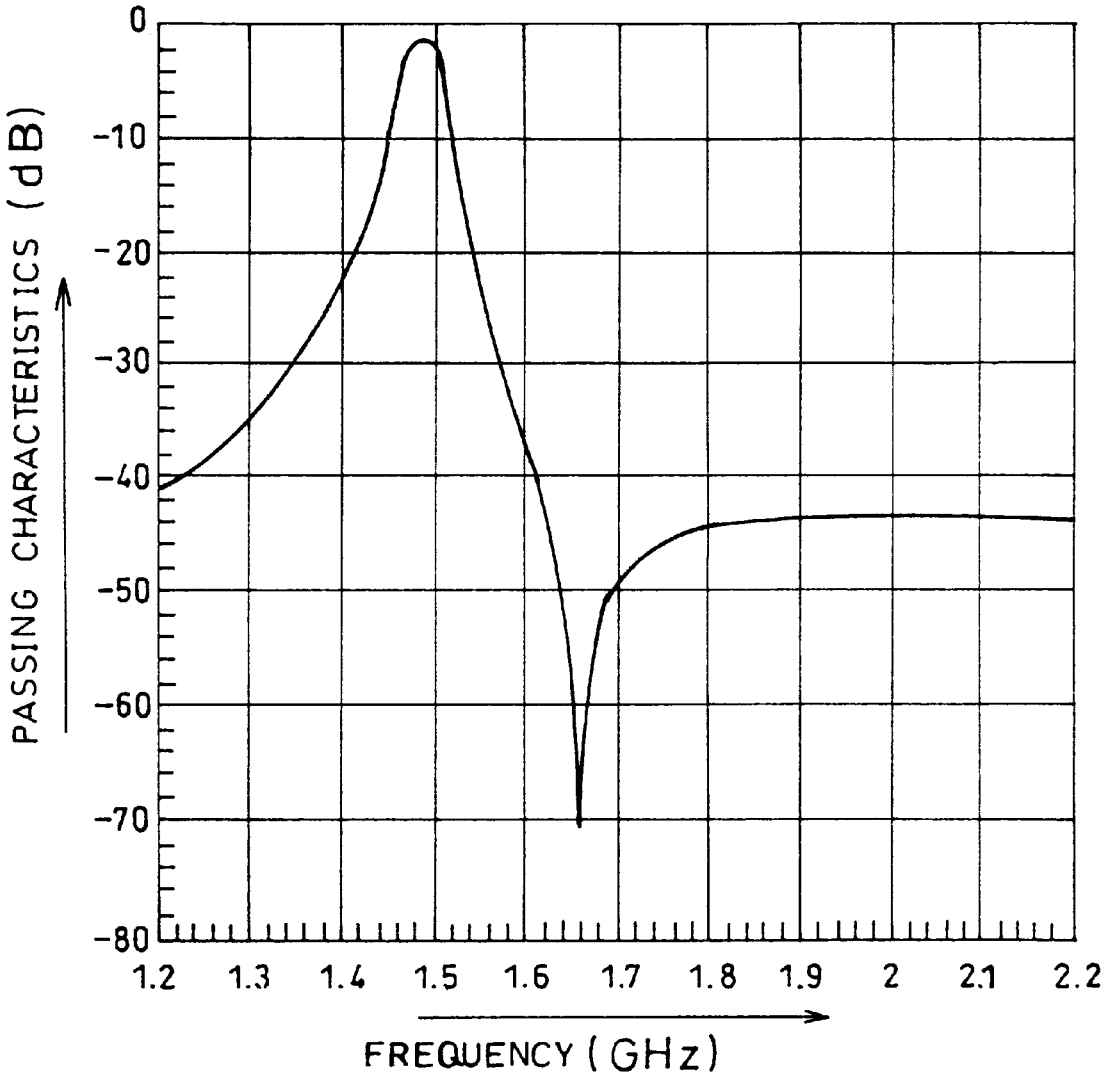
FIG. 8 is a graph explaining how the characteristics of the voltage-controlled variable-passband filter change in response to a direct-current control voltage, and showing the characteristics for a receiving circuit for the PDC system.

Accordingly, if, for example, 5V is applied by the integrated circuit 54 to the control voltage terminals 65 and 65*a*, the passing characteristics of the voltage-controlled variable-passband filter 51, as shown in FIG. 6, are such that a peak frequency in the vicinity of 1.9 GHz is obtained. Thus, the filter characteristics necessary in the first stage or between high-frequency stages of a high-frequency circuit for the PHS system can be obtained. On the other hand, if the integrated circuit 54 applies 0V, the pass characteristics, as shown in FIG. 7, are such that a peak frequency in the vicinity of 1.44 GHz is obtained. Thus, the filter characteristics necessary in the first stage or between high-frequency stages of a transmission circuit for the PDC system can be obtained. Again, if the integrated circuit 54 applies 0.5 V, the pass characteristics, as shown in FIG. 8, are such that a peak frequency in the vicinity of 1.49 GHz is obtained. Thus, the filter characteristics necessary in the first stage or between high-frequency stages of a receiving circuit for the PDC system can be obtained.

Figure 9:
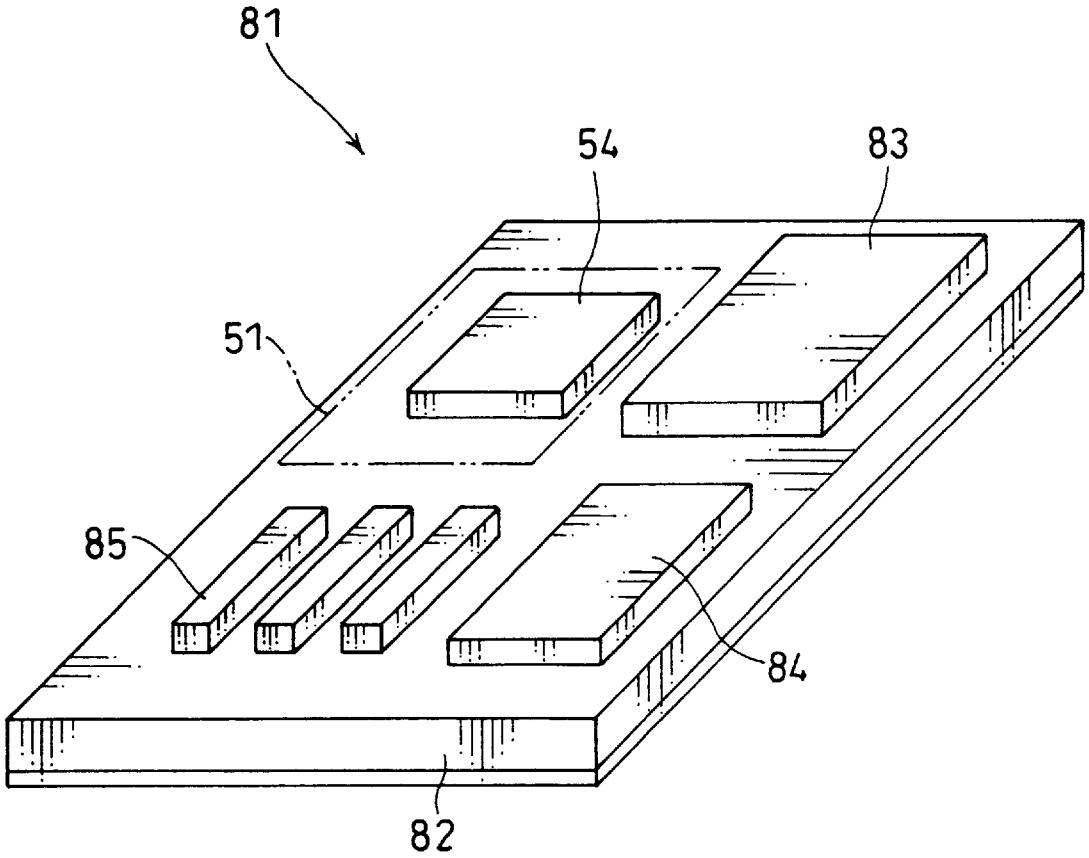
FIG. 9 is an oblique view showing a high-frequency circuit module incorporating the voltage-controlled variable-passband filter shown in FIGS. 1 through 8.

FIG. 9 shows an example of one structure for a high frequency circuit module using the voltage-controlled variable-passband filter 51, which, as discussed above, can be shared by both the PHS and PDC systems. This high-frequency circuit module 81 is made of a composite of glass and ceramic materials, and is a combination of electronic circuit components in which semiconductor components 83 through 85, such as an MMIC (Monolithic Microwave Integrated Circuit) and a VCO (Voltage Control Oscillator), are externally mounted on a substrate 82, in which are embedded conductor patterns and R, L, and C and other circuit components.

The high-frequency circuit module 81 shown in FIG. 9 is provided with the circuit patterns of the voltage-controlled variable-passband filter 51 according to the present invention embedded within a portion of the substrate 82, and the integrated circuit 54 mounted on the substrate 82. The high-frequency circuit module 81 is used in a high-frequency circuit for a terminal device which can be shared by both the PHS and PDC systems.

Figure 10:
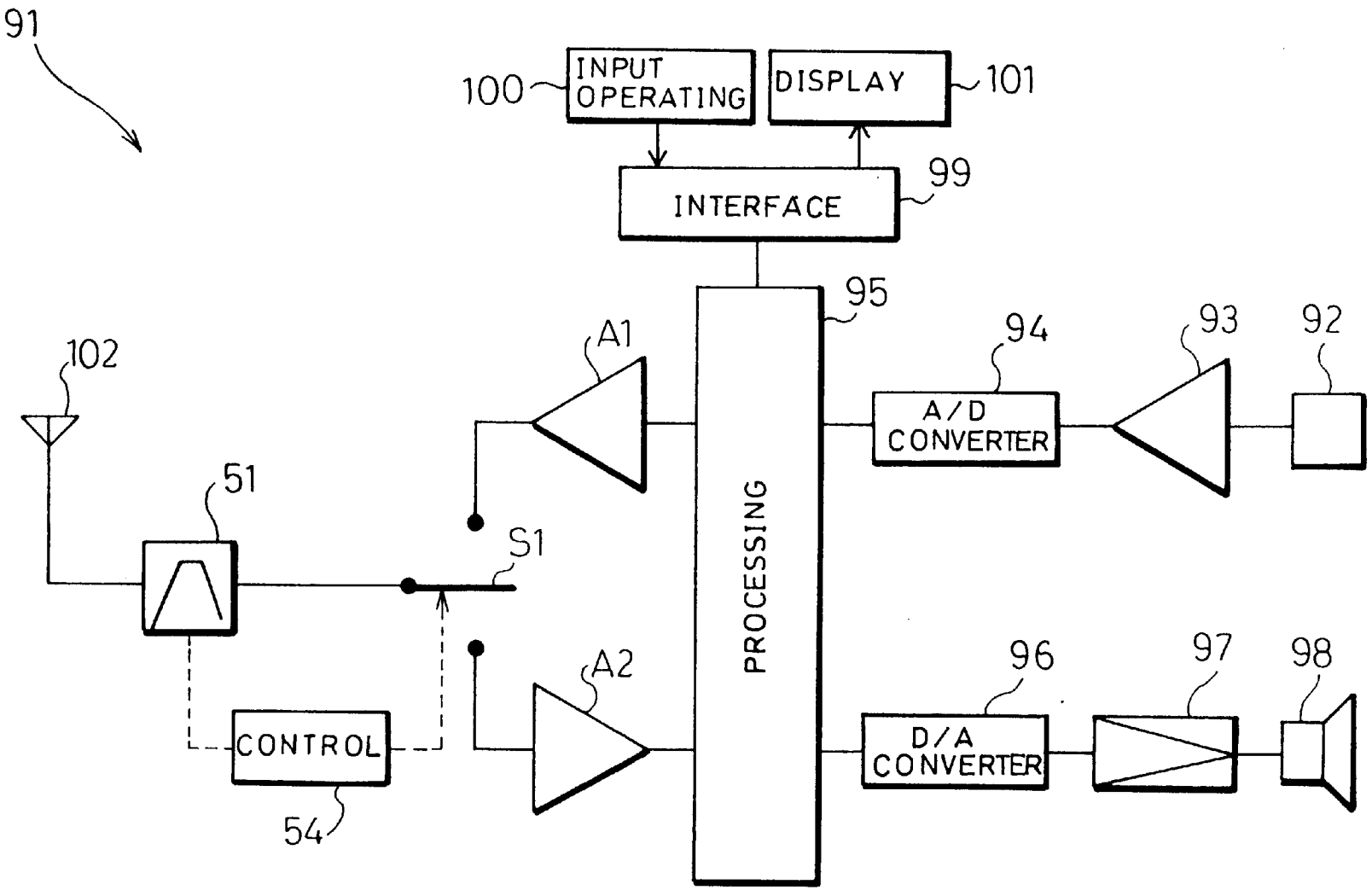
FIG. 10 is a block diagram showing the electrical structure of a terminal device shared by both the PHS and PDC systems, which incorporates the voltage-controlled variable-passband filter shown in FIGS. 1 and 2.

Further, an example of the electrical structure of a terminal device 91, to which the voltage-controlled variable-passband filter 51 is adapted, and which is to be shared by both the PHS and PDC systems, is shown in FIG. 10. Audio signals picked up by a microphone 92 are sent through an amplifier 93 to an analog/digital converter 94, where they are converted into digital signals, which are sent to a processing circuit 95, where they are modulated into transmission signals. Received signals, on the other hand, are demodulated by the processing circuit 95, and then converted into analog signals by a digital/analog converter 96, amplified by an amplifier 97, and turned into sounds by a speaker 98.

An input operating mechanism 100 such as a ten-key pad, and a display mechanism 101 realized by a liquid crystal panel or other device, are connected to the processing circuit 95 through an interface 99.

The transmission signals from the processing circuit 95, after amplification by an amplifier A1, are sent through a switch S1 to the voltage-controlled variable-passband filter 51, and then transmitted from an antenna 102. The received signals received by the antenna 102 are sent through the voltage-controlled variable-passband filter 51 and the switch S1 to an amplifier A2, where they are amplified, and then they are sent to the processing circuit 95.

Figure 25:
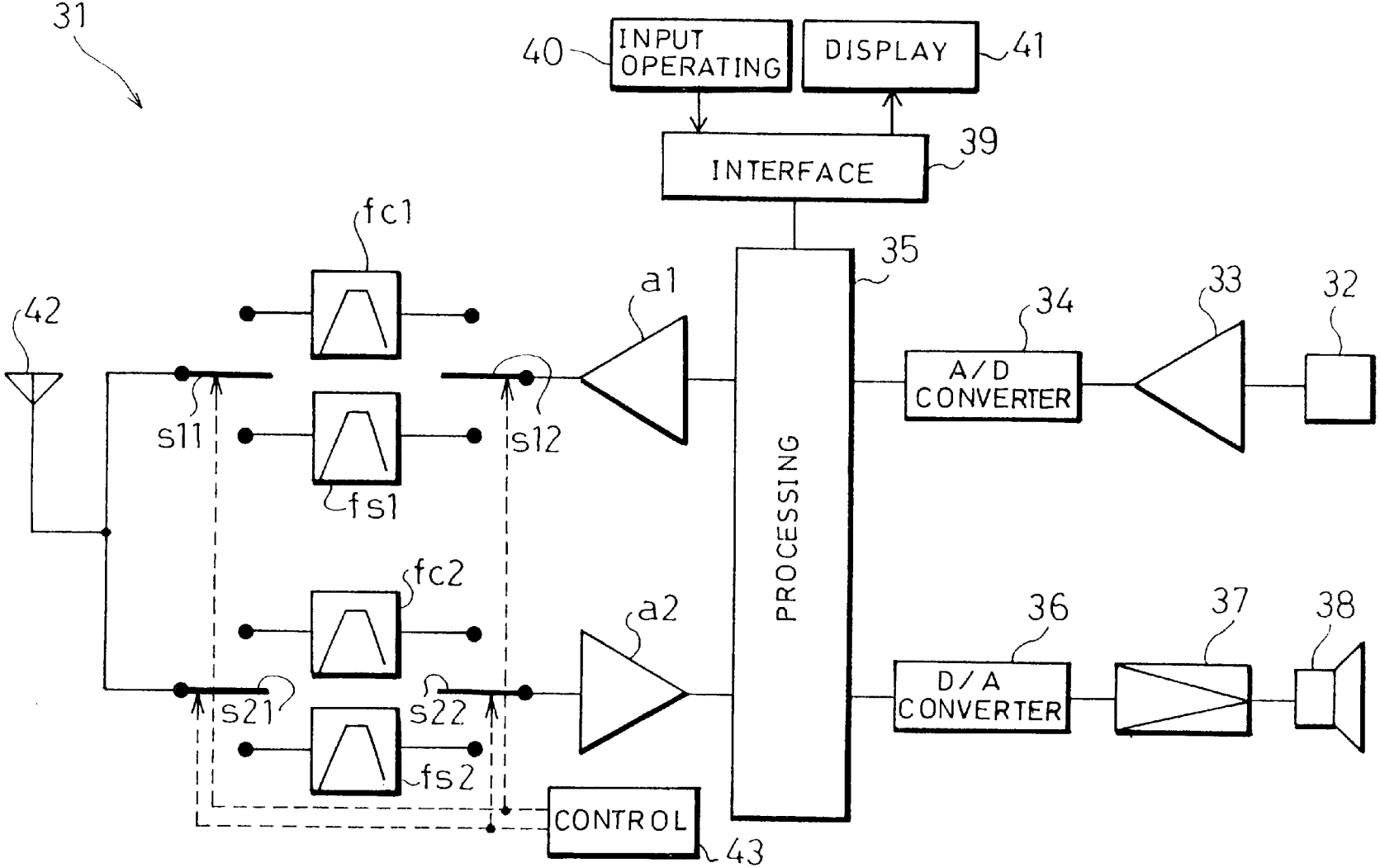
FIG. 25 PRIOR ART
FIG. 25 is a block diagram showing the electrical structure of a conventional attempt to realize a terminal device shared by both the PHS and PDC systems.
Figure 26:
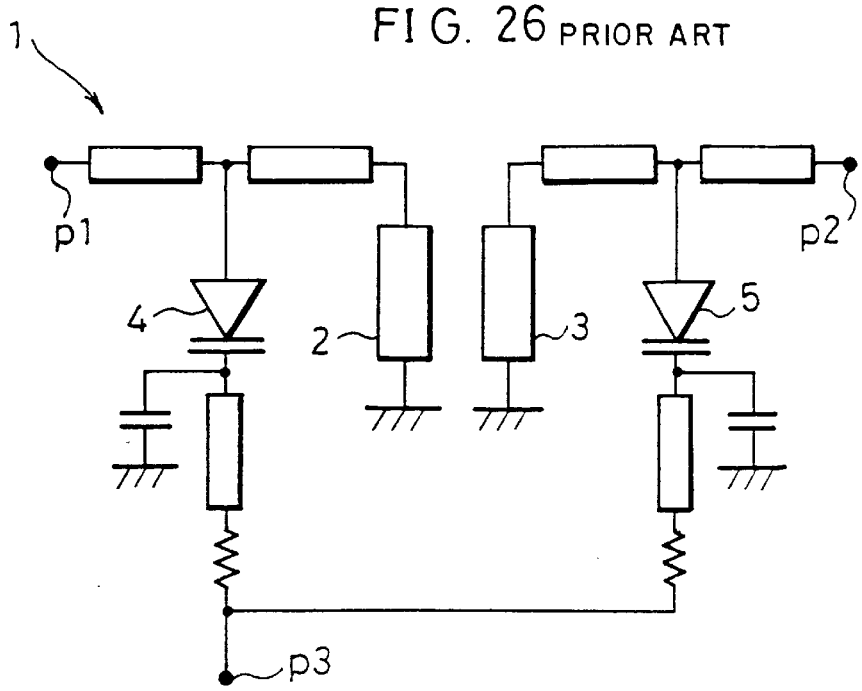
FIG. 26 PRIOR ART
FIG. 26 is an electric circuit diagram of a typical conventional voltage-controlled variable-passband filter using variable-capacity diodes.
Figure 27:
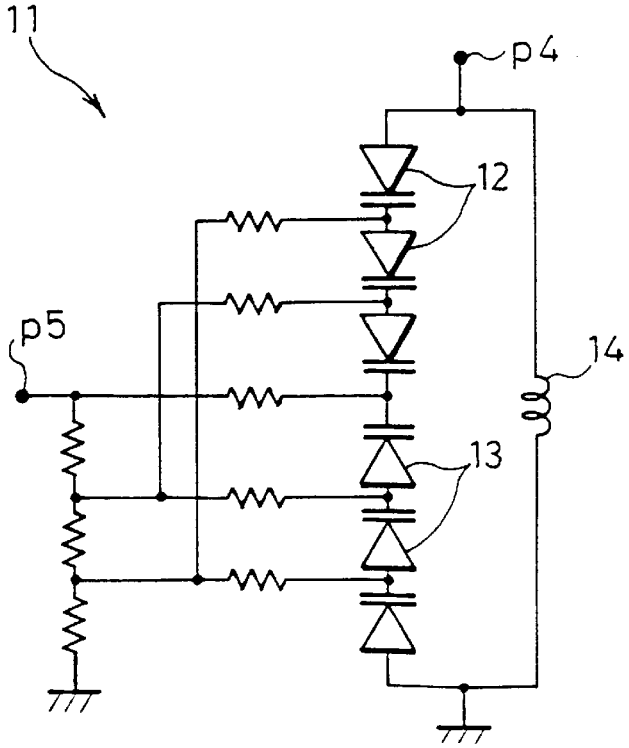
FIG. 27 PRIOR ART
FIG. 27 is an electric circuit diagram of a resonator circuit using variable-capacity diodes, which is a further example of conventional art.
Figure 28:
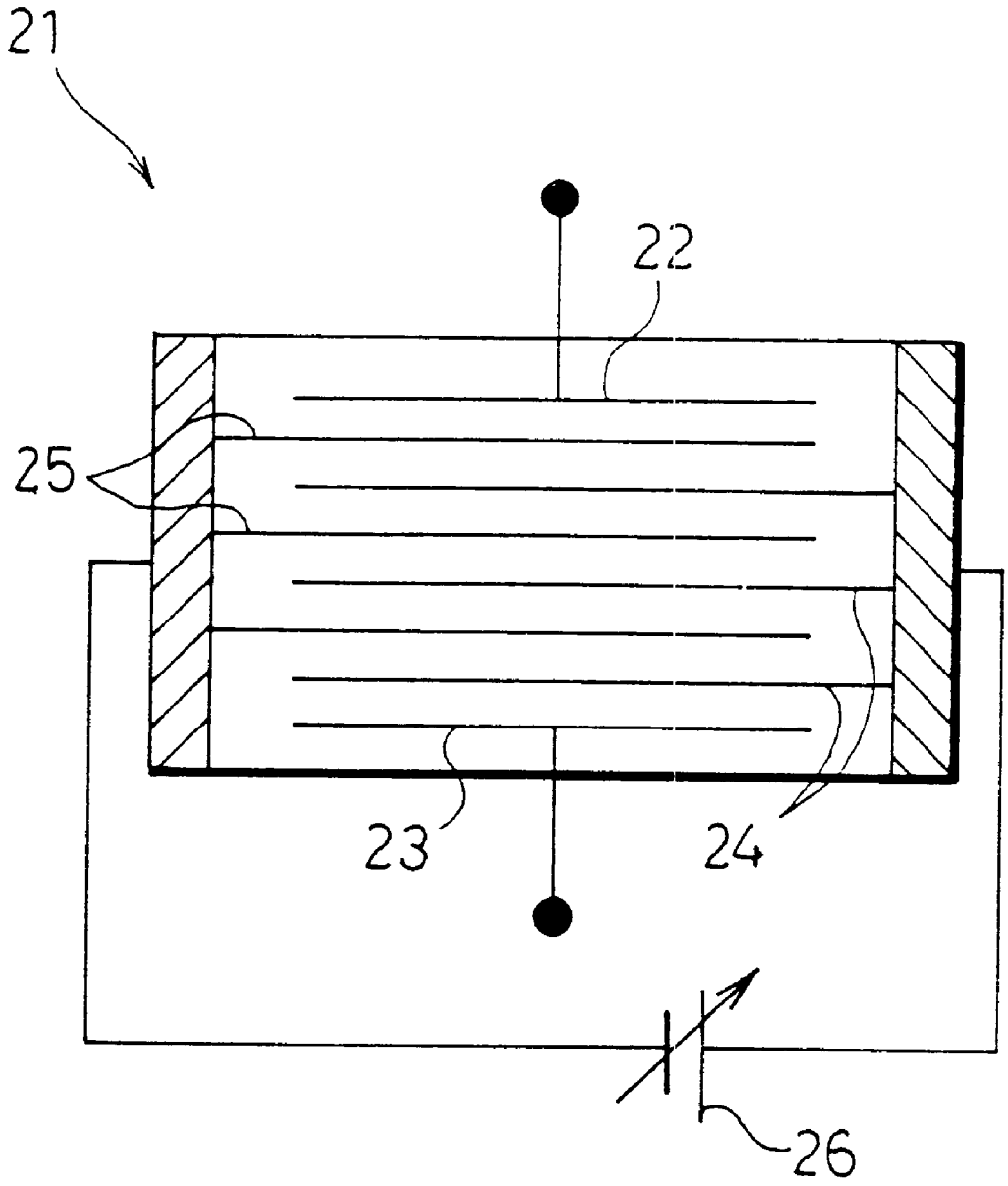
FIG. 28 PRIOR ART
FIG. 28 is a cross-sectional view schematically showing the structure of a voltage-controlled variable-capacity capacitor, which is yet a further example of conventional art.

The passing characteristics of the voltage-controlled variable-passband filter 51 are controlled by the integrated circuit 54 in response to externally applied switching signals for switching between the PDC and PHS systems and timing signals defining time slots for receiving and transmission. Further, the integrated circuit 54 may also be made to control the switch S1. In comparison to the terminal device 31 shown in FIG. 25, the number of filters and switches in the terminal device 91 structured as described above is greatly reduced, thus enabling smaller size and lighter weight.

Figure 11:
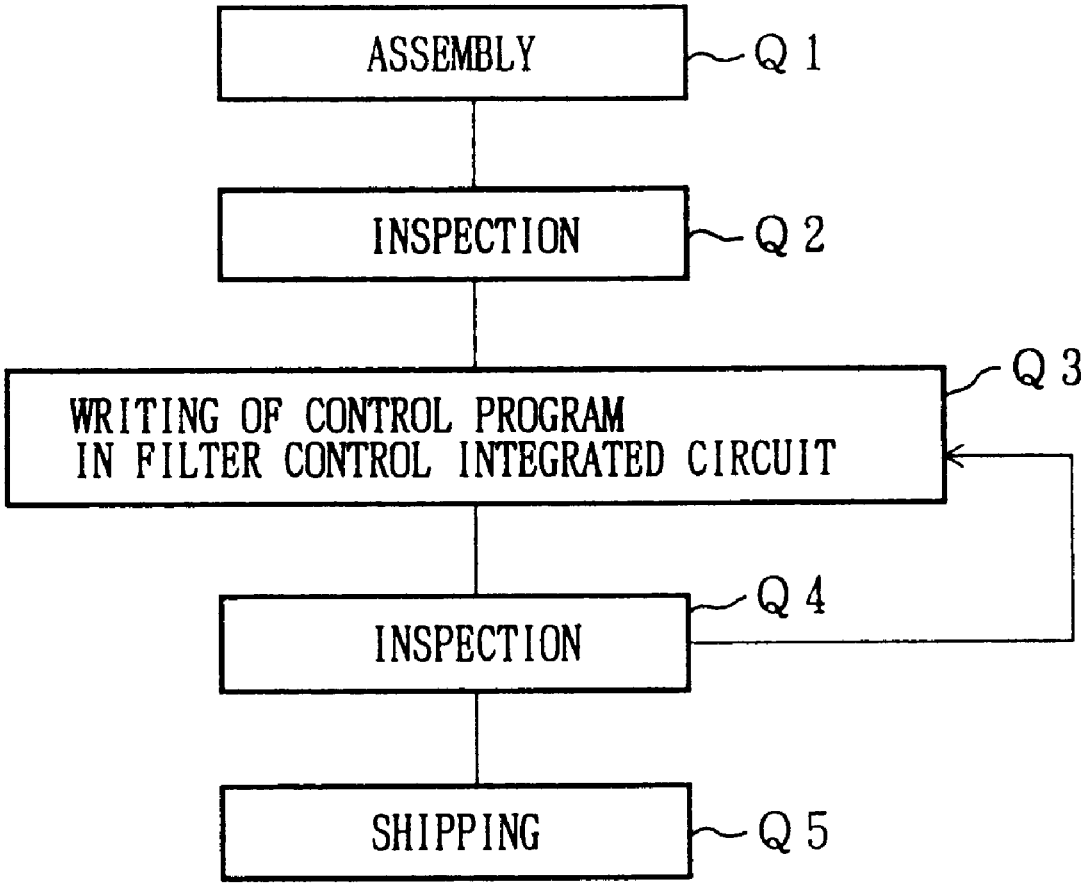
FIG. 11 is a flow chart explaining the manufacturing process for the high-frequency circuit module shown in FIG. 9.

A high-frequency circuit module 81 incorporating the voltage-controlled variable-passband filter 51 is manufactured as shown in FIG. 11. After forming of the substrate, mounting of components, and other assembly in Step Q1, an inspection of characteristics is performed in Step Q2. In Step Q3, a control program conforming to the result of this inspection is written in the integrated circuit 54. Next, in Step Q4, another inspection of characteristics is performed, and Steps Q3 and Q4 are repeated until the desired characteristics are obtained. Finally, the unit is shipped in Step Q5.

Figure 12:
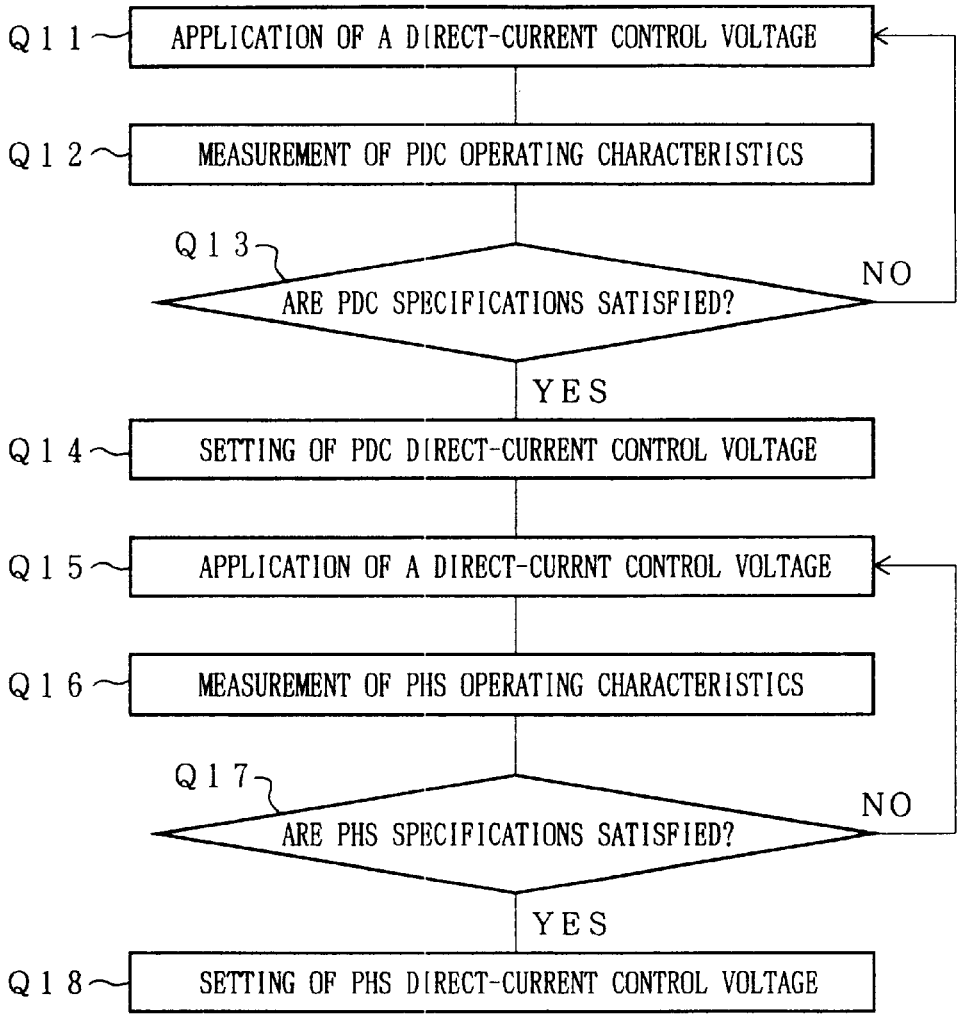
FIG. 12 is a flow chart explaining in detail the inspection step of the manufacturing process shown in FIG. 11.

FIG. 12 is a flow chart describing in detail the inspection process in Steps Q2 and Q4 above. In Step Q11, a direct-current control voltage is applied through the control voltage terminals 65 and 65*a* of the high-frequency circuit module 81. In Step Q12, the module's operating characteristics in response to that direct-current control voltage, such as sensitivity, spurious radiation, image interference ratio, and unnecessary radiation, are measured with regard to PDC specifications. In Step Q13, it is determined whether the measured results satisfy the PDC specifications, and if not, Step Q11 is repeated with a different direct-current control voltage. In this way, Steps Q11 through Q12 are repeated until a direct-current control voltage is found which satisfies the PDC specifications, and when it is found, it is set for PDC in Step Q14.

Next, in Step Q15, a direct-current control voltage is again applied, and in Step Q16 operating characteristics in response thereto are measured. In Step Q17, it is determined whether the measured results satisfy the PHS specifications, and if not, Step Q15 is repeated with a different direct-current control voltage. Steps Q15 through Q17 are repeated until a direct-current control voltage is found which satisfies the PHS specifications, and then this PHS direct-current control voltage is set in Step Q18. This is followed by Step Q3 discussed above.

Since adjustment of characteristics is accomplished by merely writing a program in the integrated circuit 54, even if excessive adjustment is made, it can be redone.

Accordingly, the desired characteristics can be obtained with greater precision and in less time than with the conventional manufacturing process shown in FIG. 29. The yield can also be improved. Further, since automatic adjustment is possible, and adjustment may be repeated as many times as necessary to obtain the desired characteristics, and, further, since fine tuning according to the surrounding temperature, etc. may be actively performed, other necessary characteristics (such as tolerance) may be tentatively set.

Figure 13:
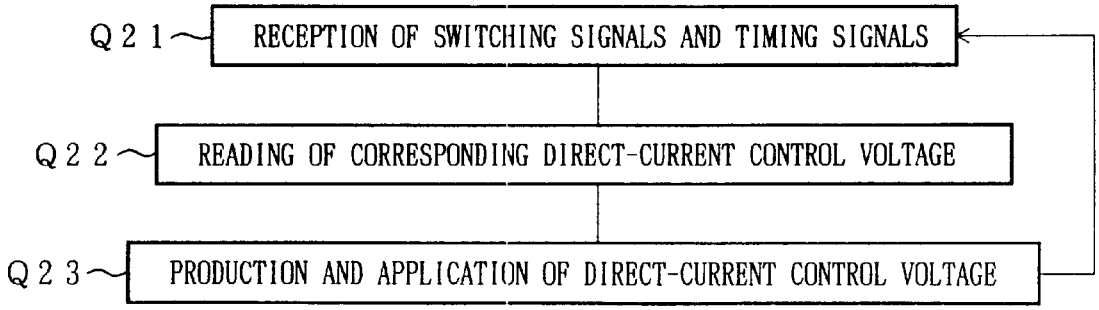
FIG. 13 is a flow chart explaining the operations of a voltage-controlled variable-passband filter.

During actual operation of the high-frequency circuit module 81, as shown in FIG. 13, in Step Q21, the integrated circuit 54 receives the system switching signals which reflect PDC/PHS switching, and timing signals which reflect transmission/receiving switching. In Step Q22, the integrated circuit 54 reads the direct-current control voltage level corresponding to those system switching signals and timing signals, and in Step Q23, a direct-current control voltage corresponding to that level is produced in the output circuit of the integrated circuit 54 and applied to the voltage control terminals 65 and 65*a*. Operations then return to Step Q21.

Accordingly, it is sufficient if the integrated circuit 54 has (1) a memory capable of storing the direct-current control voltage levels corresponding to each system switching signal and timing signal, and (2) a circuit capable of receiving and decoding the system switching and timing signals. Thus the integrated circuit 54 can be realized by a low-level microcomputer, etc.

Next, the second embodiment of the present invention will be explained with reference to FIGS. 14 and 15.

Figure 14:
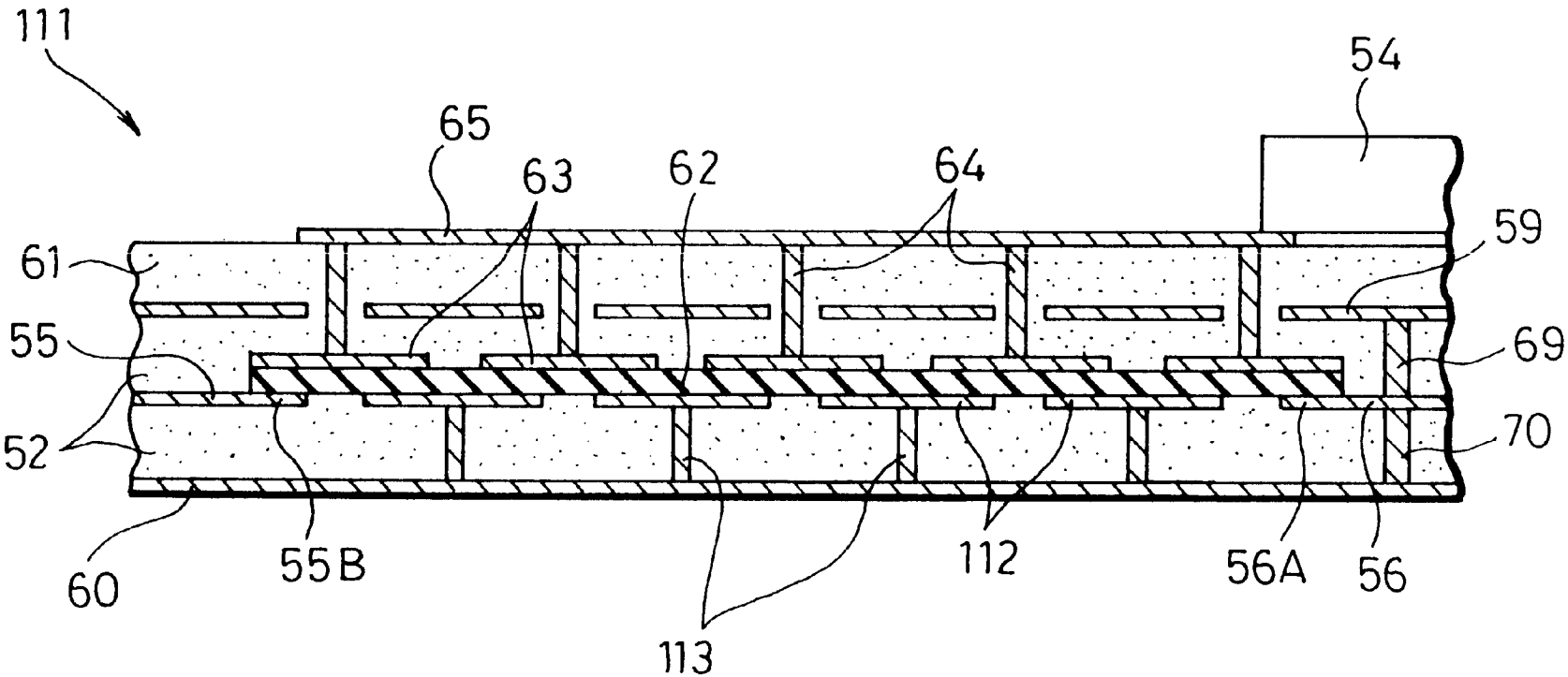
FIG. 14 is a vertical cross-sectional view showing the structure of a voltage-controlled variable-passband filter according to the second embodiment of the present invention.

FIG. 14 is a cross-sectional view showing the structure of a voltage-controlled variable-passband filter 111 according to the second embodiment of the present invention. Members of this voltage-controlled variable-passband filter 111 similar to and corresponding with those of the voltage-controlled variable-passband filter 51 will be given the same reference symbols, and explanation thereof will be omitted. What should be noted about the voltage-controlled variable-passband filter 111 is that the insulating layer 62 is provided in a band, on one surface of which are provided at certain intervals a plurality (five in the example shown in FIG. 14) of control electrodes 63. On the opposite surface of the insulating layer 62 between the end 55B of the resonator pattern 55 and the end 56A of the ground pattern 56 are provided a plurality of ground electrodes 112 so as to be staggered with the control electrodes 63. Each control electrode 63 is connected by a via hole 64 to the control voltage terminal 65, and each ground electrode 112 is connected by a via hole 113 to the ground conductive layer 60.

Figure 15:
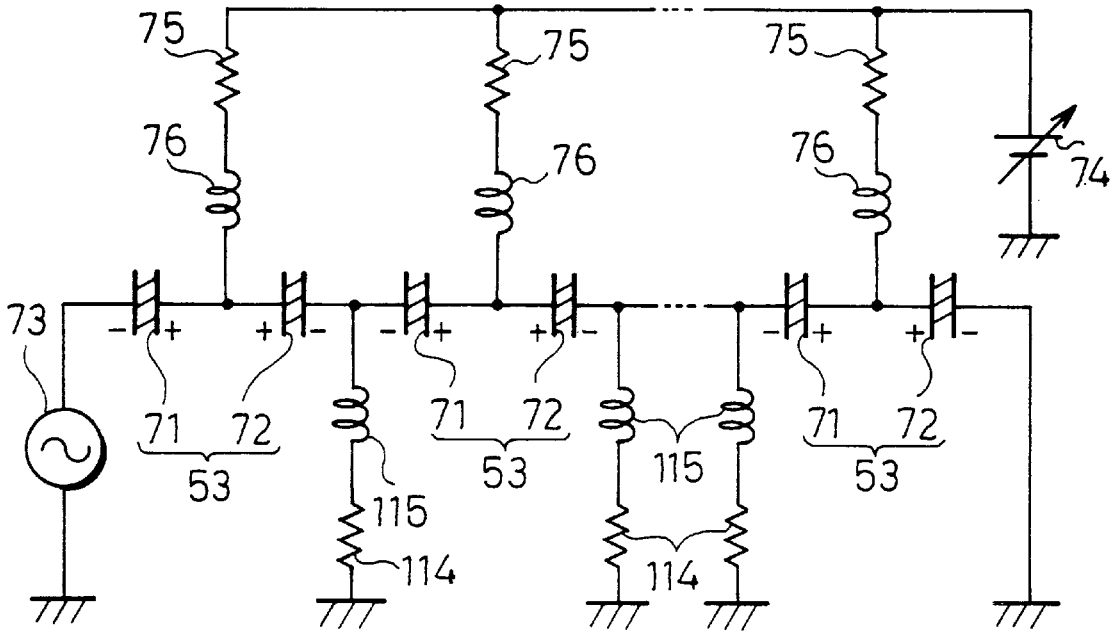
FIG. 15 is an equivalent circuit diagram showing the structure of the voltage-controlled variable-capacity capacitor and the structure for applying control voltage in the voltage-controlled variable-passband filter shown in FIG. 14.

As a result, the equivalent circuit of this structure will be as shown in FIG. 15. Each of the control electrodes 63 and each of the ground electrodes 112 also functions as a capacitive electrode, and the direct-current control voltage is applied to the insulating layer 62 between the control electrodes 63 and the ground electrodes 112, thus giving the insulating layer 62 the desired capacitance. The via holes 113, like the via holes 64, act as resistors 114 and inductors 115, and thus the area between the respective voltage-controlled variable-capacity capacitors is, from the point of view of direct current, grounded.

Accordingly, the direct-current control voltage is applied to each of the capacitors 71 and 72, and, whereas the high-frequency signal from the high-frequency signal source 73 is applied to the respective capacitors 71 and 72 with an amplitude of 1/10, a direct-current control voltage similar to that of the voltage-controlled variable-passband filter 51 is applied to each insulating layer 62 of the capacitors 71 and 72, and the desired change of capacitance can be obtained.

Accordingly, stable filter characteristics can be maintained by a low voltage, even in the case of a high-frequency signal with high power, making this filter especially effective for use in the transmission circuit of a PDC unit.

Next, the third embodiment of the present invention will be explained with reference to FIGS. 16 through 19.

Figure 16:
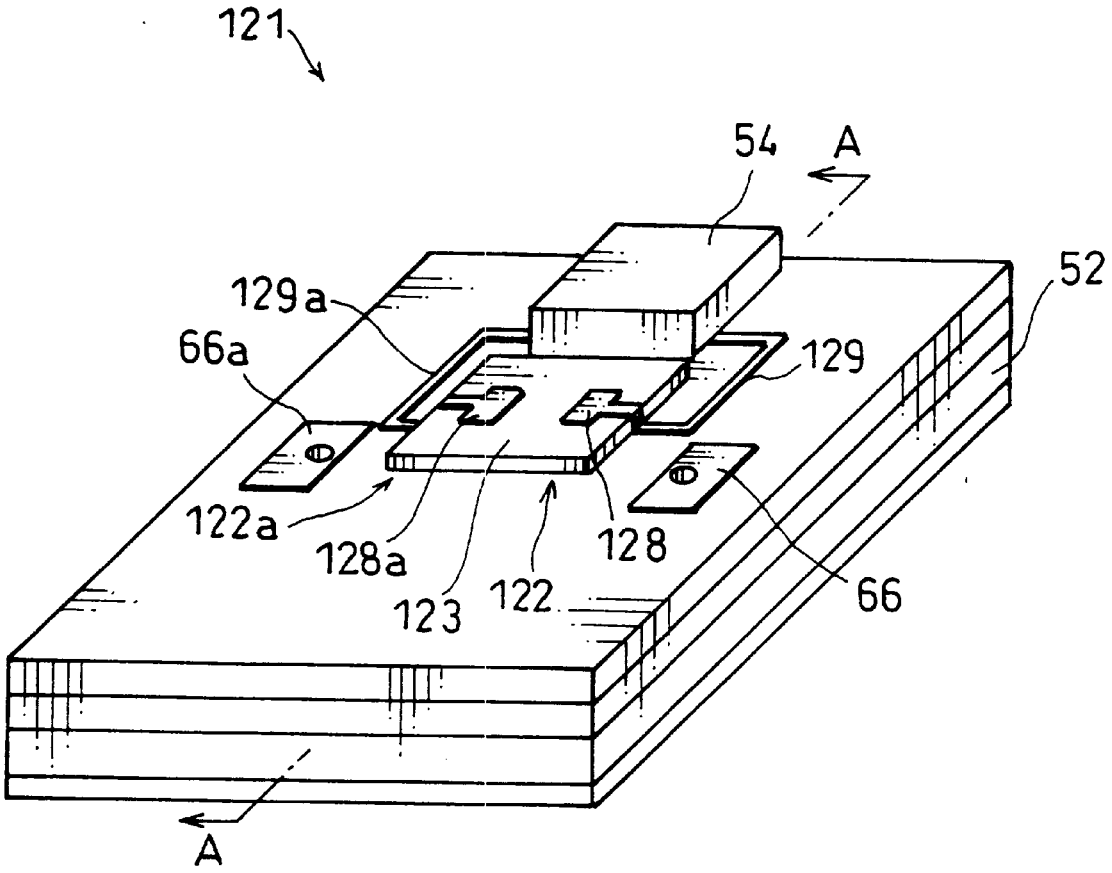
FIG. 16 is an oblique view showing the structure of a voltage-controlled variable-passband filter according to the third embodiment of the present invention.
Figure 17:
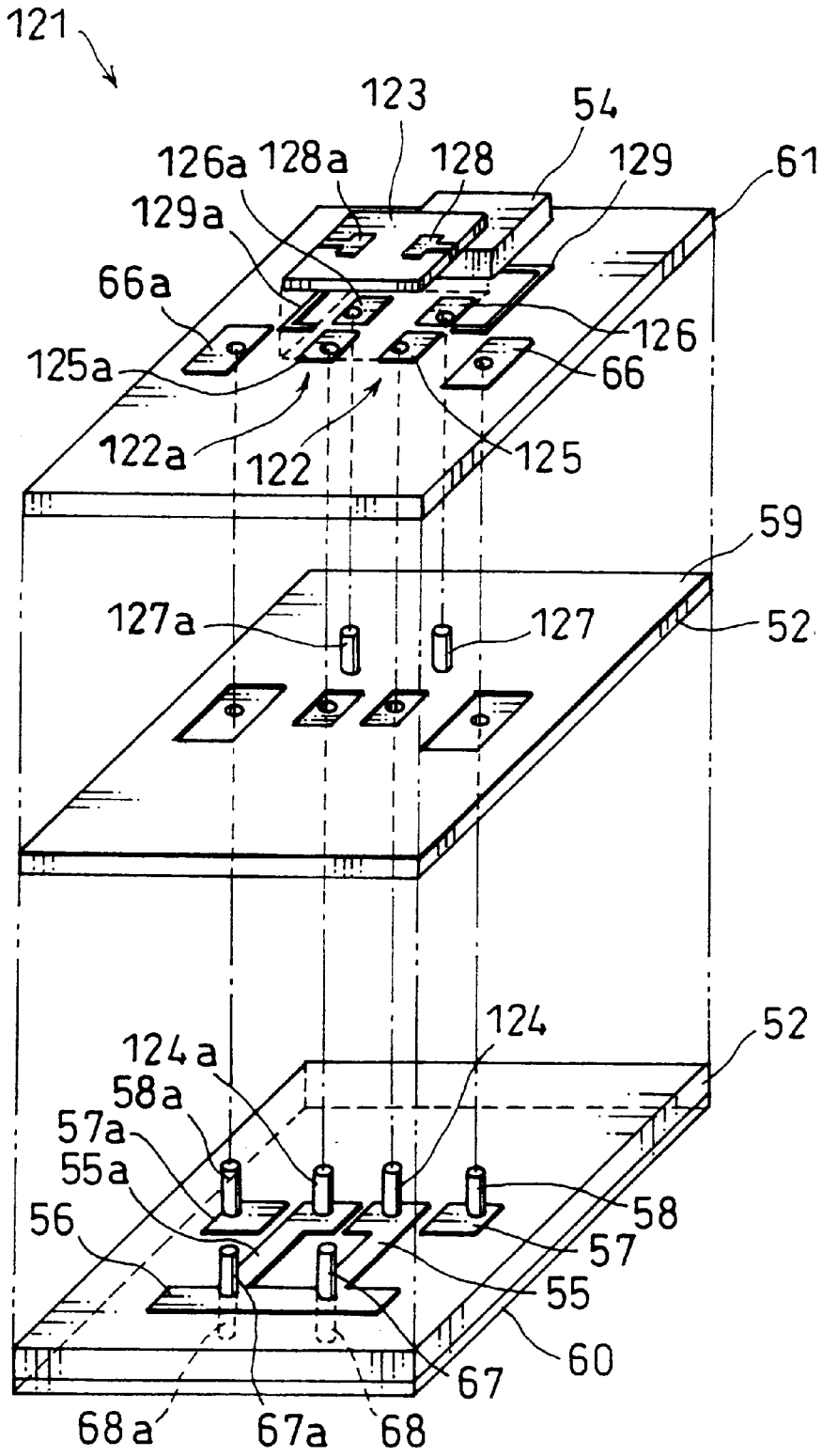
FIG. 17 is an exploded oblique view of the voltage-controlled variable-passband filter shown in FIG. 16.
Figure 18:
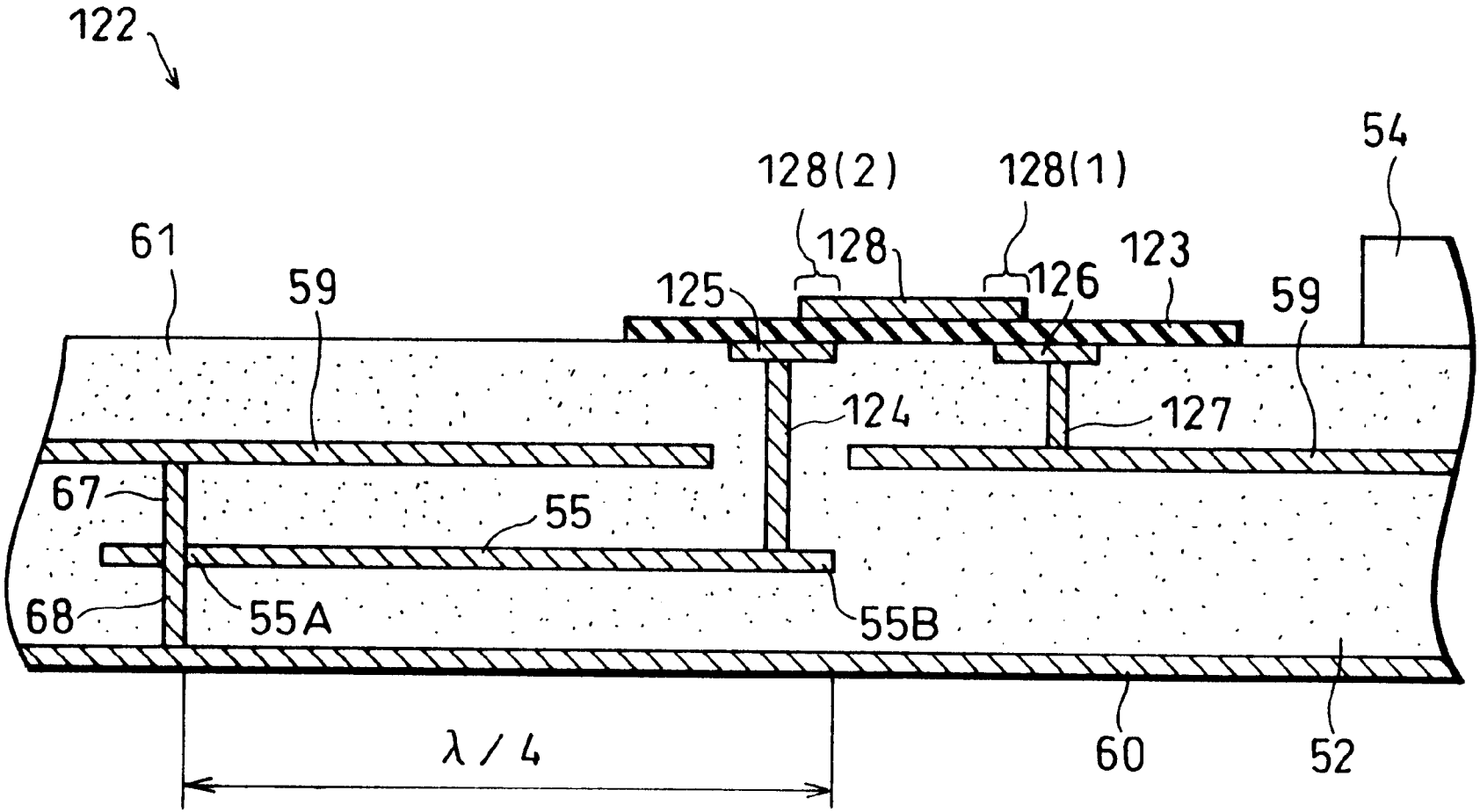
FIG. 18 is a cross-sectional view taken along line A—A of FIG. 16.

FIG. 16 is an oblique view showing the structure of a voltage-controlled variable-passband filter 121 according to the third embodiment of the present invention, FIG. 17 is an exploded oblique view of the same filter 121, and FIG. 18 is a cross-sectional view taken along line A—A of the same filter 121. Members of this voltage-controlled variable-passband filter 121 similar to and corresponding with those of the voltage-controlled variable-passband filter 51 will be given the same reference symbols, and explanation thereof will be omitted. What should be noted about the voltage-controlled variable-passband filter 121 is that an insulating layer 123, on which are provided voltage-controlled variable-capacity capacitors 122 and 122*a*, is provided on the uppermost surface of substrate 52. The following explanation will treat the voltage-controlled variable-capacity capacitor 122, with corresponding members of the voltage-controlled variable-capacity capacitor 122*a* given the same reference numerals with the addition of the letter a.

The end 55B of the resonator pattern 55 is connected by a via hole 123* to a second electrode 125 provided on the insulating layer 61, which is the uppermost layer of the substrate 52, and a third electrode 126 provided adjacent to the second electrode 125 is connected by a via hole 127 to the ground conductive layer 59. Between these electrodes 125 and 126 is provided an insulating layer 123 in the form of a thin film of a material similar to that of the insulating layer 62. On the surface of the insulating layer 123 opposite the surface where the electrodes 125 and 126 are provided is provided a control electrode 128, which is the first electrode. The control electrode 128 is connected by a bias circuit 129 to the integrated circuit 54.

The insulating layer 123 is made of, for example, $Ba_{0.7}Sr_{0.3}TiO_3$ of approximately 0.1 $\mu$m thickness, thus enabling a change in dielectric constant of approximately 60% by application of 5V of control voltage. The control electrode 128 and the bias circuit 129 may be formed by thick-film printing or photolithography.

The voltage-controlled variable-capacity capacitor 122 structured as described above is a capacitor with a three-electrode structure, in which, in the same manner as shown in FIG. 3, a first capacitor 71 and a second capacitor 72 are connected in series. The capacitive electrode of the first capacitor 71 is the conductive area 128(2) shown in FIG. 18, where the insulating layer 123 falls between the second electrode 125 and the control electrode 128 (acting as the first electrode), and the capacitive electrode of the second capacitor 72 is the conductive area 128(1) shown in FIG. 18, where the insulating layer 123 falls between the third electrode 126 and the control electrode 128.

One terminal of the capacitor 71 is connected to a high-frequency signal source 73 (corresponding to the open-end electrode of the resonator pattern 55, which is a resonator conductor), and one terminal of the capacitor 72 is connected to a ground (corresponding to the ground conductive layer 59). The respective other terminals of the capacitors 71 and 72, being the control electrode 128, are connected to each other, and the direct-current control voltage from the control voltage source 74 (corresponding to the integrated circuit 54) is applied to these mutually-connected terminals of capacitors 71 and 72 through the resistor 75 and the inductor 76 (which correspond to the bias circuit 129).

Figure 19:
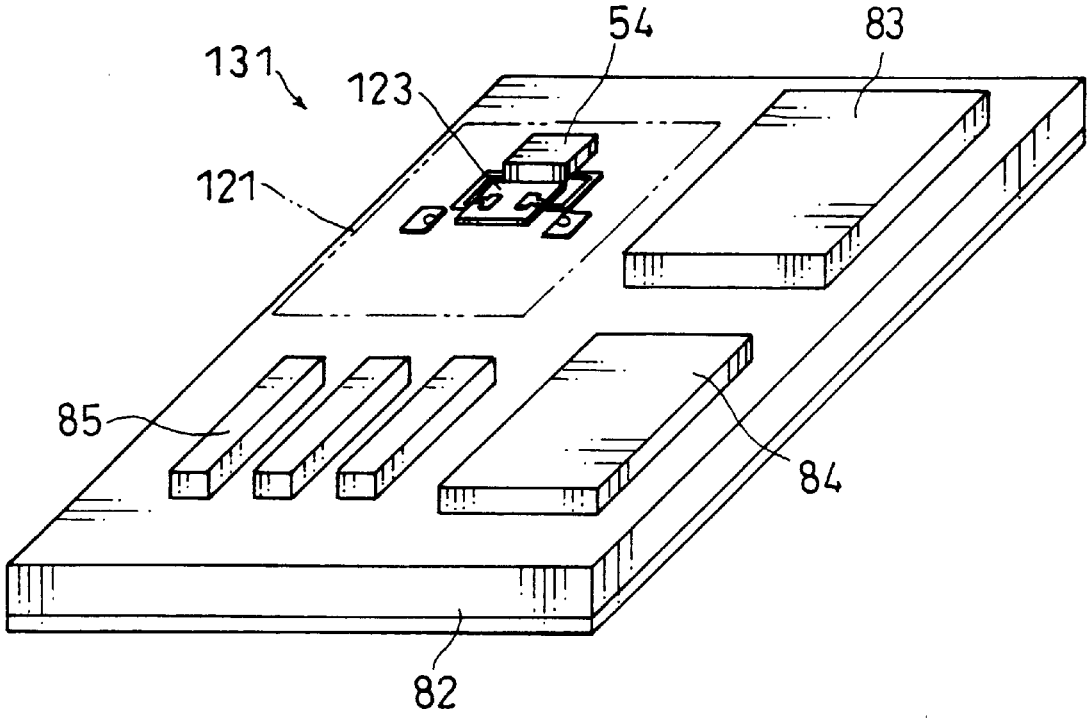
FIG. 19 is an oblique view showing a high-frequency circuit module incorporating the voltage-controlled variable-passband filter shown in FIGS. 16 through 18.

FIG. 19 shows an example of one structure for a high frequency circuit module using the voltage-controlled variable-passband filter 121. This high-frequency module 131, which is similar to the high-frequency module 81, is made of a composite of glass and ceramic materials, and is a combination of electronic circuit components in which semiconductor components 83 through 85, such as an MMIC (Monolithic Microwave Integrated Circuit) and a VCO (Voltage Control Oscillator), are externally mounted on a substrate 82, in which are embedded conductor patterns and R, L, and C and other circuit components. In the high-frequency circuit module 131 shown in FIG. 19, the circuit patterns of the voltage-controlled variable-passband filter 121 are embedded inside part of the substrate 82, and the integrated circuit 54 and the insulating layer 123 and other external members are mounted on the substrate 82. The high-frequency circuit module 131 is used as a high-frequency circuit for a terminal device shared by the PDC and PHS systems.

By providing the insulating layer 123 (on which the voltage-controlled variable-capacity capacitors 122 and 122*a* are provided) on the uppermost surface of the substrate 52, the film thickness can be controlled more easily than when an insulating layer is embedded within the ceramic substrate 52, which is formed by pressing at high temperature and pressure. There is also less danger of damage to the insulating layer, thus increasing reliability. In addition, by making the insulating layer 123 a thin film, the output voltage of the integrated circuit 54 can be kept low, and power consumption can be reduced.

Next, the fourth embodiment of the present invention will be discussed with reference to FIG. 20.

Figure 20:
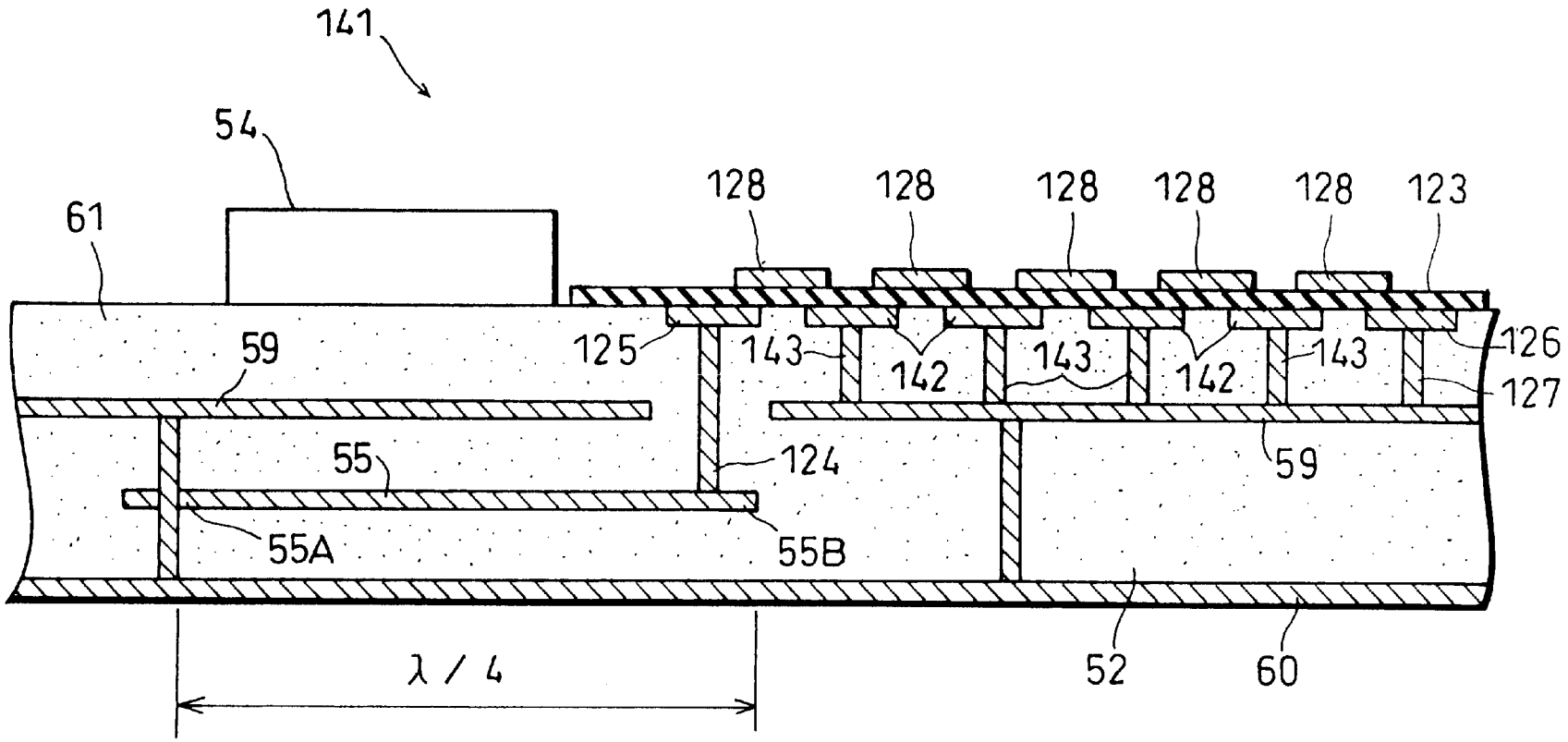
FIG. 20 is a vertical cross-sectional view showing the structure of a voltage-controlled variable-passband filter according to the fourth embodiment of the present invention.

FIG. 20 is a longitudinal cross-sectional view showing the structure of a voltage-controlled variable-passband filter 141 according to the fourth embodiment of the present invention. Members of this voltage-controlled variable-passband filter 141 similar to and corresponding with those of the voltage-controlled variable-passband filters 111 and 121 will be given the same reference symbols, and explanation thereof will be omitted. In the voltage-controlled variable-passband filter 141, the insulating layer 123 is provided on the uppermost layer of the substrate 52 in a band, like the insulating layer 62 in the second embodiment. On one surface of the insulating layer 123 are provided at certain intervals a plurality (five in the example shown in FIG. 20) of control electrodes 128. On the opposite surface of the insulating layer 123 between the second electrode 125 and the third electrode 126 are provided a plurality of ground electrodes 142, so as to be staggered with the control electrodes 128. Each control electrode 128 is connected to the integrated circuit 54 by the bias circuit 129, and each ground electrode 142 is connected to the ground conductive layer 59 by a via hole 143.

By means of the foregoing structure, the voltage-controlled variable-passband filter 141 will have the equivalent circuit shown in FIG. 15.

In the voltage-controlled variable-passband filters 111 and 141, the desired filter characteristics can be obtained at a low voltage, because the capacitors 71 and 72 in each stage are structured so as to have approximately the same capacitance. Further, high-frequency circuit modules incorporating the voltage-controlled variable-passband filters 51, 111, 121, or 141 can be used to structure, not only terminal devices shared by the PDC and PHS systems, but also transmission devices shared by the DECT (Digital European Cordless Telephone) and GSM (Global System for Mobile Communication) systems, or transmission devices shared among the PDC, PHS and satellite transmission systems (i.e., which can be adapted to three or more transmission systems).

Figure 21:
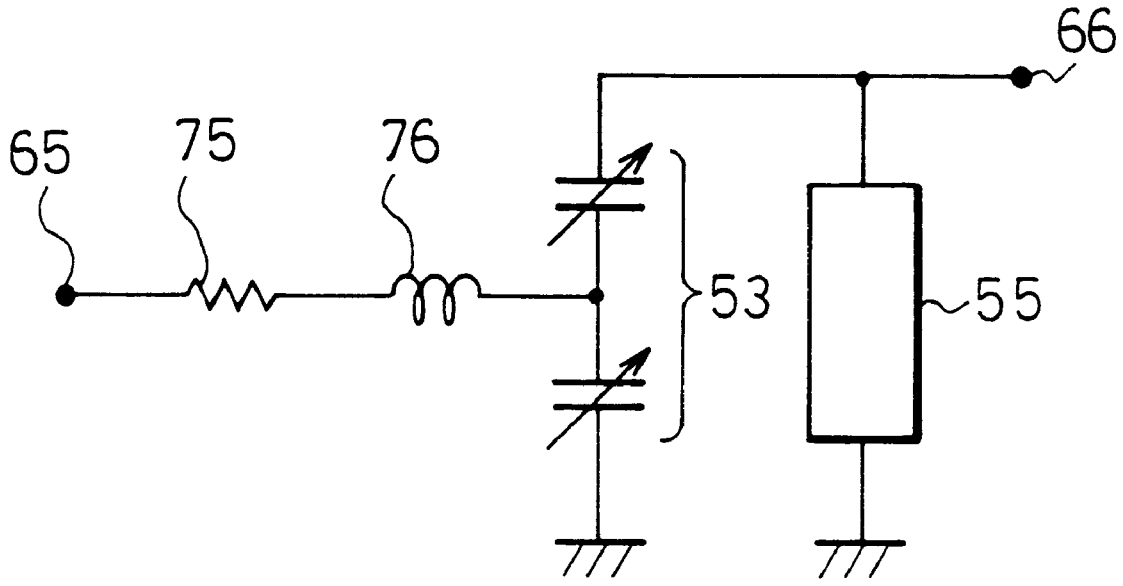
FIG. 21 is an electric circuit diagram showing an example of a resonator using the voltage-controlled variable-capacity capacitor and a resonator pattern in a one-stage structure.
Figure 22:
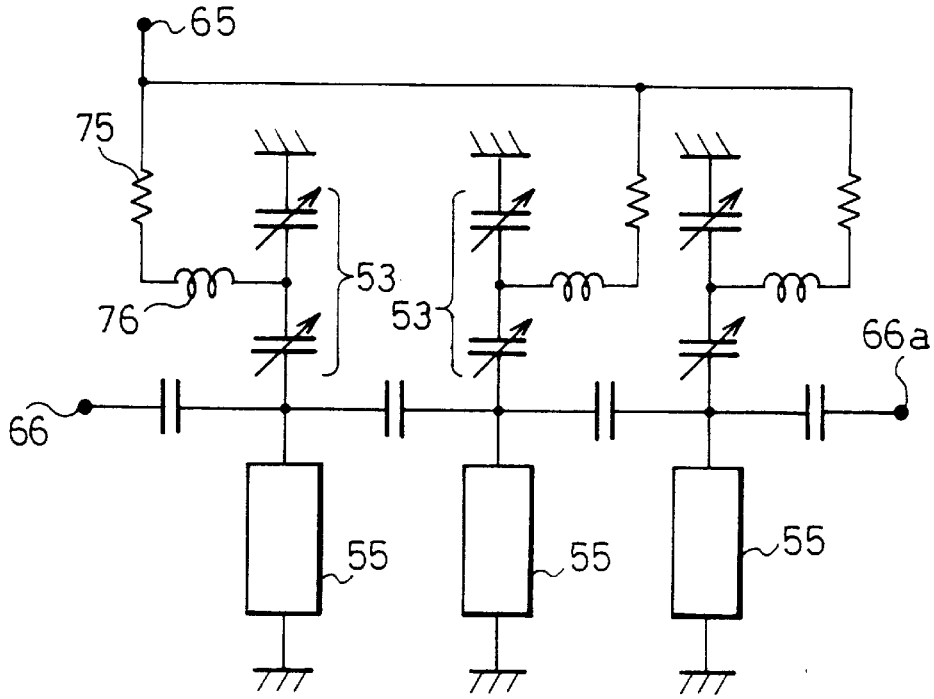
FIG. 22 is an electric circuit diagram showing an example of a filter using the voltage-controlled variable-capacity capacitor and a resonator pattern in a three-stage structure.

Again, instead of connecting the voltage-controlled variable-capacity capacitors 53 and 122 in a multi-stage structure, a resonating circuit made up of the voltage-controlled variable-capacity capacitor 53 or 122 and the resonator pattern 55 may be structured in a single stage, as shown in FIG. 21, and used, for example, as a voltage-controlled oscillator circuit (VCO). Alternatively, as shown in FIG. 22, this resonating circuit may be used in a structure of three or more stages, thus improving the filter's attenuation characteristics.

Figure 23:
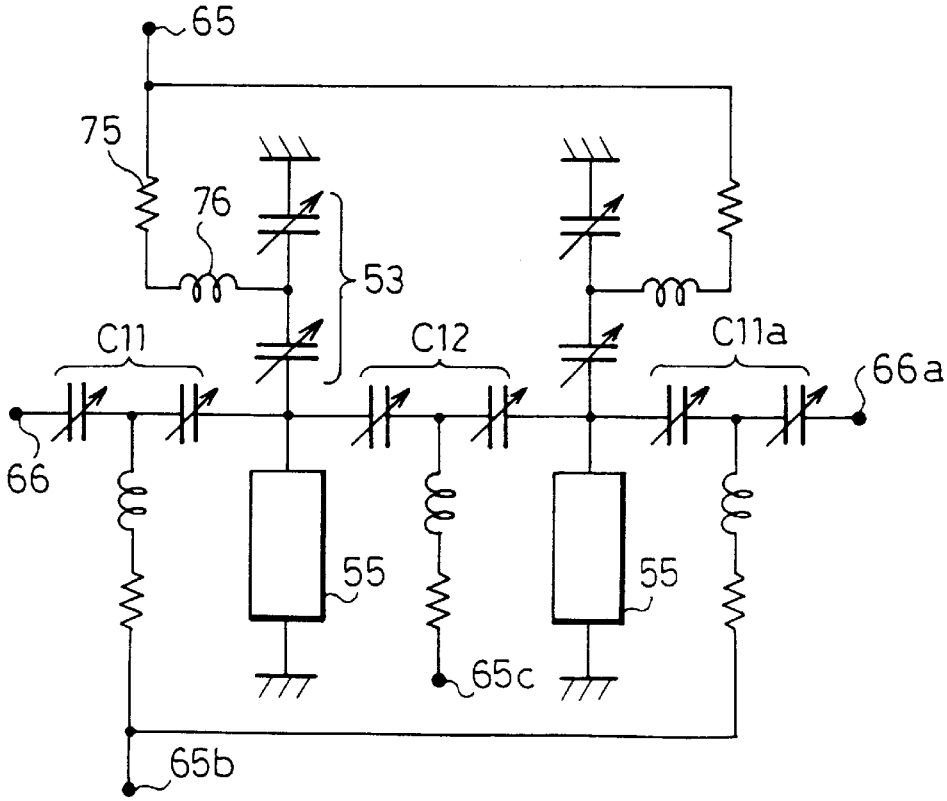
FIG. 23 is an electric circuit diagram showing a further embodiment of the voltage-controlled variable-passband filter shown in FIG. 5.

The coupling capacitances C1, C2, and C1*a* shown in FIG. 5 may be replaced, as shown in FIG. 23, with voltage-controlled variable-capacity capacitors C11, C12, and C11*a*, the capacitances of which are controlled by the direct-current control voltage from the control voltage terminals 65*b* and 65*c*. In this way, there is greater freedom to change the profile of the passing characteristics, for example by shifting the attenuation pole shown at 1.66 GHz in FIGS. 6 through 8, thus making it easier to realize the desired passing characteristics profile.

Figure 24:
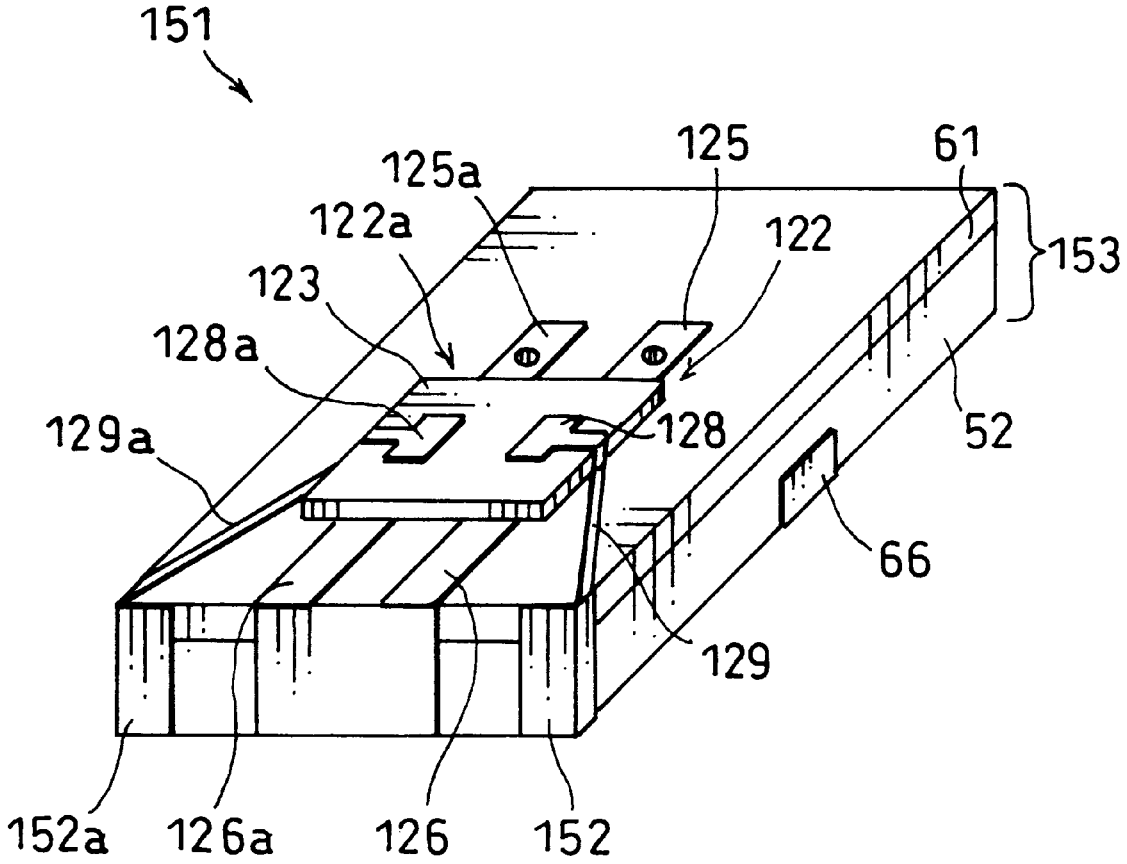
FIG. 24 is an oblique view showing a further embodiment of the voltage-controlled variable-passband filter shown in FIGS. 16 through 19.

As another alternative, the integrated circuit 54 may be separated from the filter, as shown in the voltage-controlled variable-passband filter 151 in FIG. 24. This structure is a chip-type voltage-controlled variable-passband filter, in which a control voltage from the integrated circuit 54 is sent to control voltage terminals 152 and 152*a*, and which is composed of a filter circuit 153 and voltage-controlled variable-capacity capacitors 122 and 122*a*. This voltage-controlled variable-passband filter 151 may be mounted on existing high-frequency circuit modules.

As discussed above, the first voltage-controlled variable-passband filter of the present invention is structured as a three-electrode capacitor, being provided with an insulating layer, made of dielectric material the dielectric constant of which changes according to the strength of an electric field applied thereto, integrally provided within the substrate; the first electrode for applying a control voltage being provided on one surface of the insulating layer, and the second and third electrodes being provided on the opposite surface of the insulating layer, so that the capacitor is in two-stage series connection.

As a result, a uniform electric field is applied to the entire part of the insulating layer lying between the first electrode on the one hand and the second and third electrodes on the other, thereby enabling a relatively great change in capacitance by means of a relatively small change in control voltage. With this structure, external attachment of variable-capacity capacitors is unnecessary, thus enabling smaller size, lighter weight, and streamlining of the assembly process.

Further, since the switching of the control voltage is performed by an exclusive control voltage applying means, it is possible to switch from one adjusting method to another, i.e., when adjusting so that the resonating frequency becomes higher, it is possible to readjust so that the resonating frequency becomes lower. Thus, in comparison with adjustment by means of trimming, inadequate adjustment can be eliminated, thus increasing the yield, and the adjustment is also made easier.

As discussed above, the second voltage-controlled variable-passband filter of the present invention has first electrodes in a multi-stage parallel structure, with second and third electrodes provided opposite the first- and last-stage first electrodes, and a multi-stage arrangement of ground electrodes provided opposite the first electrodes so as to be staggered therewith, with control voltage being applied between the first electrodes and the ground electrodes.

As a result, between the terminals of the capacitor is a multi-stage arrangement of capacitors in series connection, but the control voltage required is the same as for a single stage. Thus, although a high withstand voltage is required for the high power from the transmission circuits, the control voltage is still within a practical range. Accordingly, no special structure is necessary for the control voltage power source, thus enabling simplification of the overall structure.

As discussed above, the third voltage-controlled variable-passband filter of the present invention is structured so that the control voltage is applied to the first electrode through a series circuit of a resistor and an inductor.

With the above structure, the higher the frequency of a signal, the higher the impedance of the inductors, and thus the lines for applying the control voltage will not influence the high-frequency signal handled by the voltage-controlled variable-capacity capacitors. The desired electric field can also be applied to the insulating layer of dielectric material by applying the direct-current control voltage to the voltage-controlled variable-capacity capacitors through the series circuit.

Therefore, the inductors will have high impedance for the high-frequency signal, thus preventing changes in the electric field of the insulating layer due to changes in the high-frequency signal, and enabling stable operations.

As discussed above, the fourth voltage-controlled variable-passband filter of the present invention is structured so that the insulating layer is made of ceramic material, and the voltage-controlled variable-capacity capacitors, as well as the remainder of the filter circuit, is integrally provided within the substrate, which is also made of ceramic material, and the control voltage applying means is realized by an integrated circuit which is mounted on the substrate so as to be integral with it.

In the above structure, those parts of the filter circuit which do not require adjustment are embedded within the multi-layer ceramic substrate, and the control voltage applying means for controlling the control voltage is realized by an integrated circuit, which is mounted on the substrate.

Accordingly, there are fewer components to be mounted, thus enabling smaller size and lighter weight, and the desired filter characteristics can easily be obtained by adjusting the characteristics of the integrated circuit in accordance with the characteristics of the completed filter circuit embedded within the substrate.

As discussed above, the fifth voltage-controlled variable-passband filter of the present invention is structured so that the integrated circuit is capable of storing software for switching control of the control voltage.

With the above structure, the desired characteristics can be obtained by rewriting the software of the integrated circuit in accordance with the characteristics of the filter circuit integrally provided within the substrate. Automatic adjustment of the characteristics is possible, and adjustment may be repeated as many times as necessary to obtain the desired characteristics. Further, fine tuning according to the surrounding temperature, etc. may be actively performed. Accordingly, other necessary characteristics (such as tolerance) may be tentatively set.

As discussed above, the sixth voltage-controlled variable-passband filter of the present invention is structured so that the insulating layer is made of a dielectric thin-film material, and the voltage-controlled variable-capacity capacitors are provided on the upper surface of the ceramic substrate within which the remainder of the filter circuit is integrally provided, and the control voltage applying means is realized by an integrated circuit, which is also mounted on the substrate so as to be integral therewith.

In the above structure, those parts of the filter circuit which do not require adjustment are embedded within the multi-layer ceramic substrate, and the control voltage applying means for controlling the control voltage is realized by an integrated circuit, which is mounted on the substrate.

Accordingly, there are fewer components to be mounted, thus enabling smaller size and lighter weight, and the desired filter characteristics can easily be obtained by adjusting the characteristics of the integrated circuit in accordance with the characteristics of the completed filter circuit embedded within the substrate. In addition, since the insulating layer is provided as a thin film, the output voltage of the integrated circuit can be kept low, enabling reduction of power consumption. Further, the film thickness of the insulating layer can be controlled more easily than when an insulating layer is embedded within the ceramic substrate, which is formed by pressing at high temperature and pressure. There is also less danger of damage to the insulating layer, thus increasing reliability.

As discussed above, the seventh voltage-controlled variable-passband filter of the present invention is structured so that the integrated circuit is capable of storing software for switching control of the control voltage.

With the above structure, the desired characteristics can be obtained by rewriting the software of the integrated circuit in accordance with the characteristics of the filter circuit integrally provided within the substrate. Automatic adjustment of characteristics is possible, and adjustment may be repeated as many times as necessary to obtain the desired characteristics. Further, fine tuning according to the surrounding temperature, etc. may be actively performed. Accordingly, other necessary characteristics (such as tolerance) may be tentatively set.

As discussed above, the first high-frequency circuit module of the present invention is used with a multi-layer high-frequency circuit substrate, in which the components of the fourth or fifth voltage-controlled variable-passband filter above are provided in a multi-layer substrate partially or entirely, except for the integrated circuit, which is mounted on the substrate.

With the above structure, the high-frequency circuit module is arranged so as to use a high-frequency substrate in which the components other than the integrated circuit of the fourth or fifth voltage-controlled variable-passband filter are provided partially or entirely in a multi-layer substrate. With this arrangement, the integrated circuit and the other components which are necessary for a high-frequency circuit and which are to be externally mounted, such as a voltage-control oscillating circuit and a crystal oscillator, are mounted on the high-frequency circuit substrate. The high-frequency circuit module is prepared in this manner.

Accordingly, less space is taken up on the surface of the high-frequency circuit module by externally-mounted components for the voltage-controlled variable-passband filter, and the module can be made smaller.

As discussed above, the second high-frequency circuit module of the present invention is used with a multi-layer high-frequency circuit substrate, in which the components of the sixth or seventh voltage-controlled variable-passband filter above are provided in a multi-layer substrate partially or entirely, except for the integrated circuit, which is mounted on the substrate.

With the above structure, the high-frequency circuit module is arranged so as to use a high-frequency substrate in which the components other than the integrated circuit of the sixth or seventh voltage-controlled variable-passband filter are provided partially or entirely in a multi-layer substrate. With this arrangement, the integrated circuit and the other components which are necessary for a high-frequency circuit and which are to be externally mounted, such as a voltage-control oscillating circuit and a crystal oscillator, are mounted on the high-frequency circuit substrate. The high-frequency circuit module is prepared in this manner.

Accordingly, less space is taken up on the surface of the high-frequency circuit module by externally-mounted components for the voltage-controlled variable-passband filter, and the module can be made smaller.

The concrete embodiments and examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordance with the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto, a first electrode, provided on said first surface, to which the control voltage for producing the electric field is applied, and second and third electrodes, provided adjacent to and parallel with one another on said second surface, to which are applied high-frequency signals, wherein said insulating layer is made of a ceramic material, and said voltage-controlled variable-capacity capacitor, along with a remainder of the voltage-controlled variable-passband filter, is integrally provided within a substrate made of a ceramic material, and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

2. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordance with the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto, a first electrode, provided on said first surface, to which the control voltage for producing the electric field is applied, and second and third electrodes, provided adjacent to and parallel with one another on said second surface, to which are applied high-frequency signals, wherein said insulating layer is made of a dielectric thin film material, and said voltage-controlled variable-capacity capacitor is integrally provided on an upper layer of a substrate made of a ceramic material within which is provided a remainder of the voltage-controlled variable-passband filter and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

3. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordance with the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto, a plurality of first electrodes, provided on said first surface at a certain interval, to which the control voltage for producing the electric field is applied, second and third electrodes, provided on said second surface, to which are applied high-frequency signals, and a plurality of ground electrodes, provided between said second and third electrodes opposite said plurality of first electrodes, so as to be staggered with said plurality of first electrodes, wherein said insulating layer is made of a ceramic material, and said voltage-controlled variable-capacity capacitor, along with a remainder of the voltage-controlled variable-passband filter, is integrally provided within a substrate made of a ceramic material; and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

4. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordance with the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto, a plurality of first electrodes, provided on said first surface at a certain interval, to which the control voltage for producing the electric field is applied, second and third electrodes, provided on said second surface, to which are applied high-frequency signals, and a plurality of ground electrodes, provided between said second and third electrodes opposite said plurality of first electrodes, so as to be staggered with said plurality of first electrodes, wherein said insulating layer is made of a dielectric thin film material, and said voltage-controlled variable-capacity capacitor is integrally provided on an upper layer of the substrate made of a ceramic material wherein is provided a remainder of the voltage-controlled variable-passband filter; and said control voltage applying means is an integrated circuit mounted on said substrate so that said integrated circuit and said substrate are integral with each other, in which components other than saidtegrated circuit of the voltage-controlled variable-passband filter are provided at least partially in a multi-layer substrate.

5. A high-frequency circuit module for use with a multi-layer high-frequency circuit substrate, comprising:

a voltage-controlled variable-passband filter, having a voltage-controlled variable-capacity capacitor and a control voltage appying means for applying a control voltage, for varying a capacity of the voltage-controlled variable-capacity capacitor in accordance with an applied control voltage so as to vary filter characteristics, wherein said voltage-controlled variable-capacity capacitor includes an insulating layer made of a dielectric material whose dielectric constant changes according to an electric field applied thereto, a first electrode, provided on one surface of said insulating layer, to which is applied a control voltage for producing the electric field, and second and third electrodes, provided adjacent to and parallel with one another on the other surface of said insulating layer, to which are applied high-frequency signals; said voltage-controlled variable-capacity capacitor having a two-stage series structure in which the respective conductive areas of said first electrode opposite said second and third electrodes act as capacitive electrodes, said capacitive electrodes and said second and third electrodes providing two capacitors connected in series, said control voltage applying means applying the control voltage to said first electrode, wherein said insulating layer is made of a ceramic material, and said voltage-controlled variable-capacity capacitor, along with a remainder of the voltage-controlled variable-passband filter, is integrally provided within a substrate made of a ceramic material; and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

6. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordance with the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto, a first electrode, provided on said first surface, to which the control voltage for producing the electric field is applied, and second and third electrodes, provided adjacent to and parallel with one another on said second surface, to which are applied high-frequency signals, wherein said first electrode includes a plurality of electrodes connected in parallel with one another, and said second and third electrodes are provided opposite first- and last-stage electrodes of said first electrode, said filter further including a plurality of ground electrodes, provided opposite said plurality of electrodes of said first electrode, so as to be staggered therewith, wherein said insulating layer is made of a ceramic material, and said voltage-controlled variable-capacity capacitor, along with a remainder of the voltage-controlled variable-passband filter, is integrally provided within a substrate made of a ceramic material; and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

7. A high-frequency circuit module for use with a multi-layer high-frequency circuit substrate, comprising:

a voltage-controlled variable-passband filter, having a voltage-controlled variable-capacity capacitor and a control voltage appying means for applying a control voltage, for varying a capacity of the voltage-controlled variable-capacity capacitor in accordance with an applied control voltage so as to vary filter characteristics, wherein said voltage-controlled variable-capacity capacitor includes an insulating layer made of a dielectric material whose dielectric constant changes according to an electric field applied thereto, a first electrode, provided on one surface of said insulating layer, to which is applied a control voltage for producing the electric field, and second and third electrodes, provided adjacent to and parallel with one another on the other surface of said insulating layer, to which are applied high-frequency signals; said voltage-controlled variable-capacity capacitor having a two-stage series structure in which the respective conductive areas of said first electrode opposite said second and third electrodes act as capacitive electrodes, said capacitive electrodes and said second and third electrodes providing two capacitors connected in series, said control voltage applying means applying the control voltage to said first electrode, wherein said insulating layer is made of a dielectric thin film material, and said voltage-controlled variable-capacity capacitor is integrally provided on an upper layer of a substrate made of a ceramic material within which is provided a remainder of the voltage-controlled variable-passband filter; and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

8. A high-frequency circuit module for use with a multi-layer high-frequency circuit substrate, comprising:

a voltage-controlled variable-passband filter, having a voltage-controlled variable-capacity capacitor and a control voltage applying means for applying a control voltage, for varying a capacity of the voltage-controlled variable-capacity capacitor in accordancewith the control voltage so as to vary filter characteristics, wherein said voltage-controlled variable-capacity capacitor includes an insulating layer having a first surface and a second surface, said insulating layer being made of a dielectric material whose dielectric constant changes according to an electric field applied thereto;

a first electrode, provided on said first surface, to which the control voltage for producing the electric field is applied; and second and third electrodes, provided adjacent to and parallel with one another on said second surface, to which are applied high-frequency signals, wherein said first electrode includes a plurality of electrodes connected in parallel with one another, and said second and third electrodes are provided opposite first- and last-stage electrodes of said first electrode, said filter further comprising: a plurality of ground electrodes, provided opposite said plurality of electrodes of said first electrode, so as to be staggered therewith, wherein said insulating layer is made of a dielectric thin film material, and said voltage-controlled variable-capacity capacitor is integrally provided on an upper layer of a substrate made of a ceramic material within which is provided a remainder of the voltage-controlled variable-passband filter; and said control voltage applying means is an integrated circuit mounted on said substrate so that said integrated circuit and said substrate are integral with each other, in which components other than said integrated circuit of the voltage-controlled variable-passband filter are provided at least partially in a multi-layer substrate.

* * * * *